US009408009B1

(12) United States Patent
Witte et al.

(10) Patent No.: US 9,408,009 B1
(45) Date of Patent: Aug. 2, 2016

(54) COMBINED MICROPHONE SEAL AND AIR PRESSURE RELIEF VALVE THAT MAINTAINS A WATER TIGHT SEAL

(71) Applicant: Pebble Technology, Corp., Palo Alto, CA (US)

(72) Inventors: Andrew James Witte, Palo Alto, CA (US); Sean Eugene Daley, San Jose, CA (US); Tien Ching Li, Union City, CA (US); Zinovy Dolgonosov, San Francisco, CA (US); Steven William Johns, Vancouver (CA)

(73) Assignee: Pebble Technology, Corp., Redwood City, CA (US)

( * ) Notice: Subject to any disclaimer, the term of this patent is extended or adjusted under 35 U.S.C. 154(b) by 0 days.

(21) Appl. No.: 14/929,059

(22) Filed: Oct. 30, 2015

(51) Int. Cl.

| | |
|---|---|
| ***H04R 1/02*** | (2006.01) |
| ***H04R 3/00*** | (2006.01) |
| ***H04R 31/00*** | (2006.01) |
| *H01H 13/86* | (2006.01) |

(52) U.S. Cl.
CPC ..... *H04R 31/00* (2013.01); *H01H 13/86* (2013.01); *H04R 2201/003* (2013.01)

(58) Field of Classification Search
CPC .... H04R 31/00; H04R 31/003; H04R 31/006; H04R 201/00; H04R 201/003; H04R 1/406; H04R 3/00; H04M 1/035; H01H 1/66; H01H 13/86; H01H 37/5427; H01H 50/023; H01H 71/326; H01H 2033/66223; H01H 2207/034; H01H 2223/002
USPC ..... 381/26, 56, 91, 111, 112, 113, 114, 381/115, 122, 150, 170, 175, 355, 360, 369, 381/375; 29/594, 609.1, 896.23; 361/141, 361/142, 174, 679.23
See application file for complete search history.

(56) References Cited

U.S. PATENT DOCUMENTS

| | | | | |
|---|---|---|---|---|
| 2,423,014 | A * | 6/1947 | Gilman | H04R 1/22 381/150 |
| 2011/0013799 | A1* | 1/2011 | Fang | H04R 1/086 381/355 |
| 2011/0261986 | A1* | 10/2011 | Murayama | G01M 3/26 381/332 |
| 2013/0271902 | A1* | 10/2013 | Lai | H04R 1/02 361/679.01 |
| 2014/0294217 | A1* | 10/2014 | Yamaguchi | H04M 1/035 381/334 |
| 2014/0339012 | A1* | 11/2014 | Richardson | G10K 11/18 181/202 |
| 2015/0172796 | A1* | 6/2015 | Chao | B29C 45/14008 381/332 |

* cited by examiner

*Primary Examiner* — Vivian Chin
*Assistant Examiner* — William A Jerez Lora
(74) *Attorney, Agent, or Firm* — Rutan & Tucker, LLP

(57) ABSTRACT

A wearable electronic device is discussed. The device has a housing and a processor in the housing. The processor can enable the wearer of the device to select different operations from an onscreen display. The device also has a communication circuit in the housing to transmit wirelessly to another device cooperating with the electronic device. The device has a microphone hole penetrating the housing to a microphone, a microphone seal component, and a waterproof material in the housing. The microphone seal component has channels and when compressed against the waterproof material can i) allow sound waves in air to pass through to the microphone inside the housing behind the waterproof material and the microphone seal component, ii) form a water tight seal for the microphone hole penetrating the housing, and iii) provide an air pressure equalization mechanism between internal pressure inside the housing and atmospheric pressure external to the housing.

20 Claims, 12 Drawing Sheets

COMBINED MICROPHONE SEAL AND AIR PRESSURE RELIEF VALVE THAT MAINTAINS A WATER TIGHT SEAL

FIELD

The design generally relates to wearable electronics devices that are sealed but still are designed to endure the adverse effects of air pressure drop from increased altitudes as well as being water proof and/or water resistant.

BACKGROUND

Typically, sealed devices are sealed from both air and water such that the display of the wearable electronics devices may bulge out and/or extend when air pressure drops and may depress inward when external atmospheric pressure increases.

SUMMARY

In general, a wearable electronic device has a housing and a processor in the housing. The processor can process commands to present an onscreen display on a display screen to enable the wearer of the electronic device to select a number of different operations. The wearable electronic device also includes a communication circuit in the housing. The communication circuit can transmit wirelessly to another computing device cooperating with the electronic device. The wearable electronic device further has a microphone hole penetrating the housing such that the hole leads to at least a microphone, a microphone seal component, and a waterproof material in the housing. The microphone seal component has one or more channels and when compressed against the waterproof material can provide multiple functions. The functions include i) allowing sound waves in air to pass through to the microphone located inside the housing behind the waterproof material and the microphone seal component, ii) assisting to form a water tight seal for the microphone hole penetrating the housing, and iii) providing an air pressure equalization mechanism between an internal pressure inside the housing of the electronic device and atmospheric pressure external to the housing of the electronic device. The wearable electronic device has a computer readable storage medium, in the housing, accessible to the processor such that the processor stores instructions executable by the processor to generate different operations on the onscreen display.

In an embodiment, a microphone seal component has one or more channels. The microphone seal component has a front face with a fairly level surface on a first portion and a raised portion in the shape of an O-ring or some other gasket shape on a second portion of the front face. The channels can be cut out or molded into the fairly level surface of the first portion of the face. A center hole can be formed in the microphone seal component. The one or more channels of the microphone seal component can cooperate with a waterproof material such that when the microphone seal component is compressed against the waterproof material, the combination can i) allow sound waves in the air to pass through to the microphone located inside a housing behind the waterproof material and the microphone seal component, ii) assist to form a water tight seal for the microphone hole penetrating the housing, and iii) provide an air pressure equalization mechanism between an internal pressure inside the housing and atmospheric pressure external to the housing.

In an embodiment, a method of making a microphone hole for a wearable electronic device waterproof and/or water resistant that has an air pressure equalization pathway, includes a number of example steps. A microphone seal component that has a front face with a fairly level surface on a first portion and a raised portion in a shape of an O-ring or some other gasket shape on a second portion of the front face is used. The microphone seal component has one or more channels cut or formed into the fairly level surface first portion of the face. A center hole is formed in the microphone seal component in order to seal the microphone hole penetrating a housing that leads to a microphone. The microphone seal component and a waterproof material located in the housing cooperate with each other. The microphone seal component has one or more channels and when compressed against the waterproof material can provide multiple functions. The functions include i) allowing sound waves in air to pass through to the microphone located inside the housing behind the waterproof material and the microphone seal component ii) assisting to form a water tight seal for the microphone hole penetrating the housing, and iii) providing an air pressure equalization mechanism between an internal pressure inside the housing of the electronic device and atmospheric pressure external to the housing of the electronic device.

BRIEF DESCRIPTION OF THE DRAWINGS

The multiple drawings refer to the example embodiments of the design.

Figure 1:
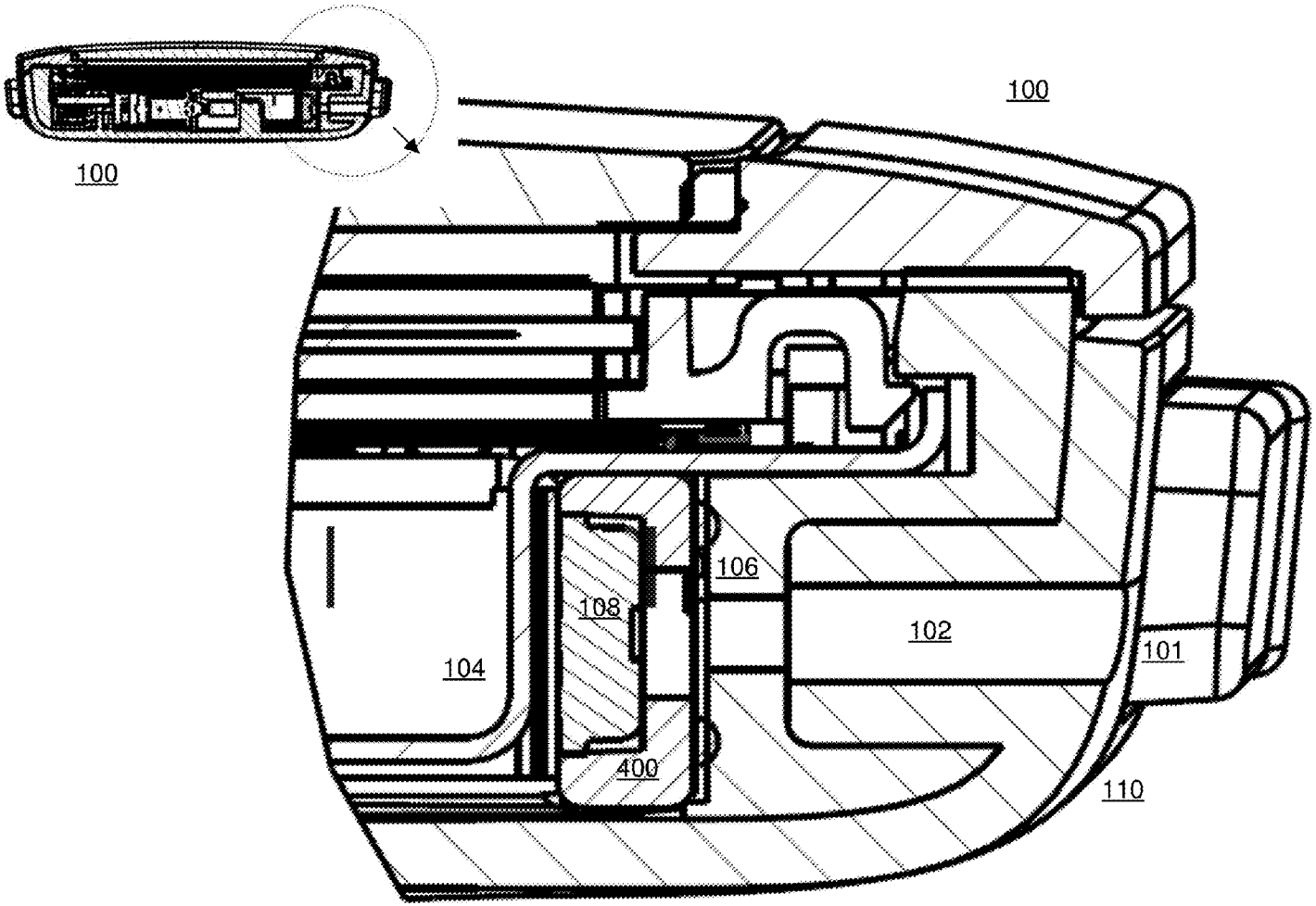
FIG. 1 illustrates a diagram of an embodiment of the housing with its hole in the housing body, the waterproof material, the microphone seal component, the microphone, a bracket, and other components.

While the design is subject to various modifications and alternative forms, specific embodiments thereof have been shown by way of example in the drawings and will herein be described in detail. The design should be understood to not be limited to the particular forms disclosed, but on the contrary, the intention is to cover all modifications, equivalents, and alternatives falling within the spirit and scope of the design.

DETAILED DISCUSSION

In the following description, numerous specific details are set forth, such as examples of wearable electronic devices, named components, connections, number of databases, etc., in order to provide a thorough understanding of the present design. It will be apparent; however, to one skilled in the art that the present design may be practiced without these specific details. In other instances, well known components or methods have not been described in detail but rather in a block diagram in order to avoid unnecessarily obscuring the present design. Thus, the specific details set forth are merely exemplary. The specific details discussed in one embodiment may be reasonably implemented in another embodiment. The specific details may be varied from and still be contemplated to be within the spirit and scope of the present design.

In general, a waterproof and/or water resistant wearable electronic device, e.g., a waterproof electronic watch, has a housing. The housing can include a processor that can enable the wearer of the electronic device to select a number of different operations through an onscreen display of the device. The housing also can have a communication circuit that can wirelessly, e.g., Bluetooth, Zigbee, cellular or Wi-Fi, communicate with another device. The housing further includes a microphone. The microphone receives sound waves through a microphone hole. From one side, the microphone hole penetrates the housing and leads outward from the microphone. From another side the microphone hole is in contact with the outside environment of the housing. A microphone seal component as well as some waterproof material in the housing seals the housing such that water cannot penetrate through the microphone hole. The microphone seal component has a front face with a fairly level surface on a first portion as well as a raised portion in a shape of an O-ring or some other gasket shape on a second portion. The microphone seal component has one or more channels cut out of it or molded into the fairly level surface of the first portion of the microphone seal component. The microphone seal component also has a center hole is also formed in the microphone seal component. When the microphone seal component is compressed against the waterproof material the following functionalities can happen. First, the seal allows sound waves outside the microphone hole pass through microphone hole and get to the microphone located in the housing behind the waterproof material. Second, the microphone seal component assists in forming a water tight seal between the microphone hole and the housing. Third, at the same time the one or more channels of the microphone seal component provides an air pressure equalization mechanism between an internal pressure inside the housing and atmospheric pressure external to the housing.

The wearable electronic device is 1) waterproof and/or water resistant and at the same time, 2) does not bulge out when the wearer goes up on a mountain or travels in an airplane, and 3) does not get depressed inward when the wearer dives under water. An example of a wearable electronic device is a watch, a clip on fitness tracker, necklace, earring or ear bud, eyeglasses, or other device. In another example, the wearable electronic device may be a smart watch such as a "Pebble Time" or "Pebble Time Steel" models. The following drawing and text describe various example implementations of the design.

FIG. 1 illustrates a diagram of an embodiment of the housing with its hole in the housing body, the waterproof material, the microphone seal component, the microphone, a bracket, and other components. The microphone seal component has one or more channels and when combined with a waterproof material is configured to provide multiple functions of i) allowing sound waves in air to pass through to the microphone located inside the housing behind the waterproof material and the microphone seal component, ii) while assisting to form a water tight seal up to at least 2 atmospheres (atms) for the microphone hole penetrating the housing, and iii) providing an air pressure equalization mechanism between an internal pressure inside the housing of the electronic device and atmospheric pressure external to the housing of the electronic device. The microphone hole penetrates the housing that leads to a microphone, a microphone seal component, and a waterproof material in the housing. The housing of the wearable electronic device with a microphone hole in the housing body allows sound waves to come in to the microphone located inside the housing behind the waterproof material and microphone seal component with one or more channels. The one or more channels act as a pressure relief valve (e.g. pressure equalization mechanism) to allow pressure equalization between the internal pressure inside the housing of the electronic device and atmospheric pressure external to the housing of the electronic device.

The microphone seal component has one or more channels that are configured to cooperate with the waterproof material. The waterproof material is compressed between the body of the housing and the microphone seal component. A bracket compresses the microphone, the microphone seal with one or more channels, the pliable sealing substrate, and the waterproof material as well as any other materials against the body of the housing to assist in making the entire electronic device waterproof down to at least three atmospheres (atms). In alternative embodiments, the microphone seal component may assist to form a water tight seal up to 1 atm, 2 atms, 3 atms, 4 atms, 5 atms, or more, as well as merely being waterproof and/or water resistant to level 1 of the IPX liquid intrusion table, level 2, level 3, level 4, level 5, level 6, level 7, level 8 or up to level 9K.

Thus, the microphone connects to the housing through the microphone seal component with the one or more channels and through the waterproof material. The waterproof material may be a material such as Gore-Tex or nylon. The waterproof material covers the opening inside the housing at the location where the microphone hole penetrates the housing. The waterproof material may be a multilayered composite fabric constructed to repel water molecules while allowing smaller molecules than water, such as sound waves in air, to pass through the waterproof material. However, the waterproof material prevents water molecules from penetrating through its layered composite fabric when compressed up to a pressure of 3 to 5 atmospheres (atms) of water pressure. In alternative embodiments, the waterproof material prevents water molecules from penetrating through its layered composite fabric when compressed up to 1 atm, 4 atms, 5 atms or more or waterproof and/or water resistant to level 1 of the IPX liquid intrusion table, level 2, level 3, level 4, level 5, level 6, level 7, level 8 or up to level 9K. The gas permeable membrane of the waterproof material allows air and sound waves to pass through while preventing larger molecules such as water from penetrating through that membrane. Thus, the waterproof Gore-Tex or nylon material in a ring-shape is formed over an outer circumference of the opening of the microphone in the housing. The waterproof rating of five atms, which means it can be submerged down to 40 meters (130 ft.) can be tested in both fresh and salt water, allowing the user to shower, dive or swim while wearing the watch.

As described, in an embodiment, a wearable electronic device 100 includes a housing 110, a processor in the housing. The processor is configured to process commands to present an onscreen display on a display screen 212 to enable the wearer of the electronic device to select a number of different operations. The wearable electronic device 100 includes a communication circuit in the housing. The communication circuit is configured to transmit wirelessly to another computing device cooperating with the electronic device. (See, for example, FIGS. 7-8).

As described, the wearable electronic device has a microphone hole 102 penetrating the housing that leads to a microphone 108, a microphone seal component 400, and a waterproof material 106 in the housing. The microphone seal component has one or more channels 408 and when compressed against the waterproof material 106 is configured to provide multiple functions. The functions include i) allowing sound waves in air to pass through to the microphone located inside the housing behind the waterproof material 106 and the microphone seal component 400, ii) while assisting to form a water tight seal for the microphone hole penetrating the housing, iii) providing an air pressure equalization mechanism between an internal pressure inside the housing of the electronic device and atmospheric pressure external to the housing of the electronic device, and iv) and similar functions.

The wearable electronic device also has a computer readable storage medium, e.g., solid-state memory 840, in the housing accessible to the processor 820 and stores instructions executable by the processor to generate the number of different operations on the onscreen display 212.

Thus, the waterproof material 106 presses against the microphone seal component 400, which may be a rubber boot or combination of gaskets.

Figure 2A:
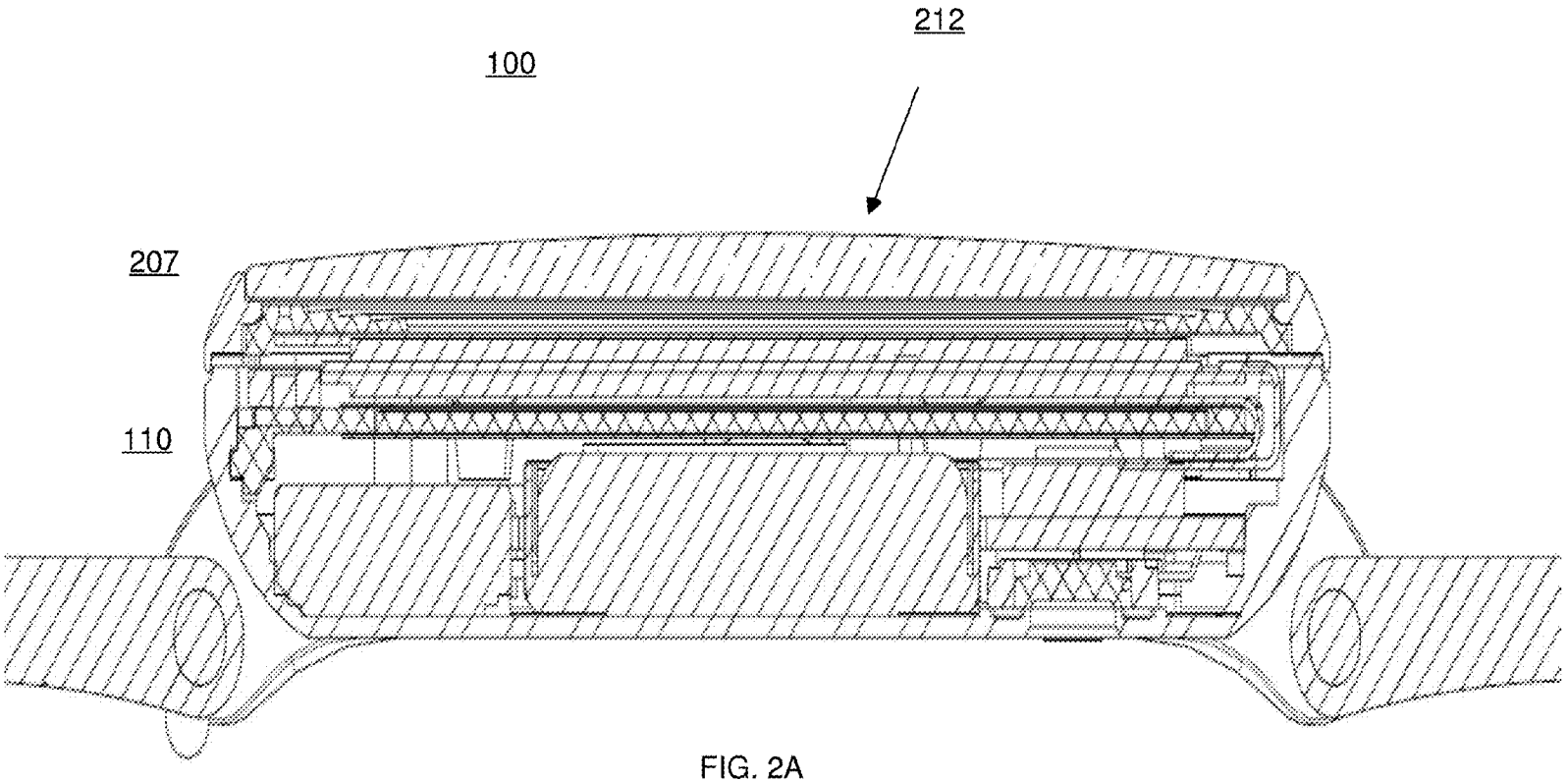
FIGS. 2A and 2B show diagrams of embodiments of the wearable electric device with the housing, the bracket, the pliable substrate securing the housing to the bezel and the display screen.
Figure 2B:
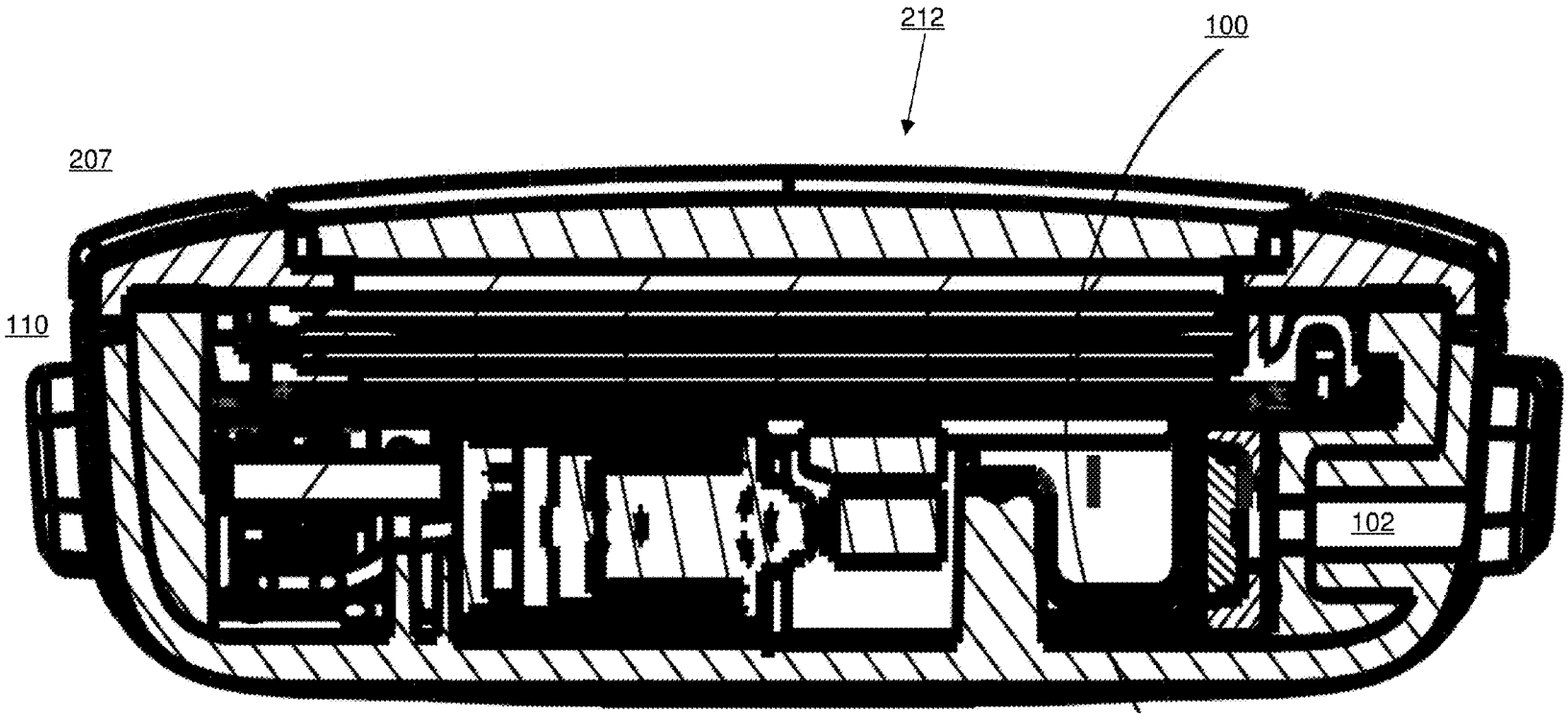

FIGS. 2A and 2B show diagrams of the watch or electric device with the housing, the bracket, the pliable substrate securing the housing to the bezel and the display screen. The bezel 207 and the display screen 212 connect to the housing 110 through the pliable sealing substrate.

In an embodiment, the wearable electronic device is a wristwatch that has a watch housing in which the onscreen display bears a time indication, either digital or analog. In certain instances, the wristwatch may be a smart watch. In one embodiment, the wristwatch has one or more manipulatable physical buttons that are arranged on the housing of the watch. In other embodiments, the wristwatch may have a touch screen, scrolling device, additional buttons or a combination of some or all of these. A flexible wristband is engagable with the housing of the watch to hold the housing of the watch onto a wearer. In one embodiment, the wristwatch has a bezel. The channels 408 cooperate with the waterproof material 106 to act as the air pressure equalization mechanism to prevent deformation in an appearance of the bezel and display screen when the internal pressure inside the housing of the electronic device is significantly greater than the atmospheric pressure external to the housing of the electronic device.

In an embodiment, the electronic wearable device 100 has a bezel coupled to the display screen 212. At least the bezel connects to a pliable sealing substrate to secure the bezel and corresponding display screen 212 to the housing of the electronic device 100. The pliable sealing substrate can expand and compress. The channels 408 in the microphone seal component 400 cooperate with the waterproofing material 106 to act as the pressure equalization mechanism. This can help alleviate any deformation of the bezel and the display screen 212 when exposed to significant expansion stresses as well as reduce an expansion and contraction cycling of the pliable sealing substrate when exposed to atmospheric pressure changes.

As discussed, the bezel connects to a pliable sealing substrate to secure the bezel and corresponding display screen 212 to the housing 110 of the electronic wearing device 100, where the pliable sealing substrate can expand and compress. The pliable sealing substrate, such as a foam type adhesive, may function to secure one or both of the bezel and corresponding display screen 212 to the housing 110 of the electronic device 100. Likewise, the two halves of the housing may be sealed with foam sealant that has double back tape. Such a foam sealant allows for some expansion and contraction but must be protected from being cycled and deformed too much.

Also, the bezel can be metal and act as the antenna for the smart watch. The bezel being a metal antenna needs to be separated from a metal housing by some sort of insulator between the two layers. When this is an air insulator it is called a reveal gap that allows for manufacturing dimension tolerances of other components to be slightly off and still be able to maintain a sealed electronic device.

Therefore, by equalizing i) the internal pressure inside the housing and ii) the external pressure of the atmosphere, then the weaker structural components of the bezel and the display screen do not deform or change shape due to the sealed device's internal pressure being significantly more or significantly less relative to the outside atmospheric pressure. The air equalization path formed by the channel and air flowing through the waterproof material out the microphone hole maintains a nice appeasing static look to the bezel and the display screen. When the internal and external pressures are not equalized then the bezel and display screen can bow or otherwise change the look and appearance of the electronic device.

In an embodiment, the electronic wearable device 100 has a bezel coupled to the display screen 212 as well has a lithium based battery. The lithium-based battery is located in the housing. In one embodiment, the lithium-based battery has at least 130 milliampere-hour (mAh) in electrical storage capacity, and can power the electronic components in a wearable electronic device. The lithium-based battery can also power the display screen, the communication circuit, and the processor. The display screen is selected from the group of any of an ePaper display, a monochrome LCD display, and a color LED backlit display, and OLED display, that all consume lower battery power than color LCD screens. The battery contains enough capacity of at least 130 mAh to allow the display screen to stay on constantly and last up to five days on a single charge of the battery.

In an example, the wearable electronics device has a Lithium-ion battery with battery power of 130-150 mAh that can last up to 7 days (assuming 20-30 notifications a day).

In an embodiment, the watch can be charged using a modified USB-cable that attaches magnetically to the watch to maintain water resistance capability.

As noted, an electronic wearing device can change altitude because the wearer travels on a plane or goes up on a mountain or alternatively dives into water. The electronic device's internal pressure will change relative to the external atmospheric pressure. While underwater, the electronic device including the housing and any penetrations through the housing may experience up to three atms of compression and water molecules can try to penetrate through the waterproof material and enter the interior of the housing of the electronic device. Note, the housing may be designed to withstand penetrations of an extra safety cushion of up to 5 atms of water pressure to ensure that electronic device may consistently withstand up to 3 atms of compression after extensive usage and under different conditions and does not allow water inside the housing. Likewise, the electronic device may experience expansion stresses when taken to higher altitudes such as in the mountains or on airplane flights. Thus, the electronic device may be subject to both significant compression stresses underwater and significant expansion stresses when in higher altitudes because the internal portions of the housing are sealed from the atmosphere.

Figures 3A, 3B, 3C:
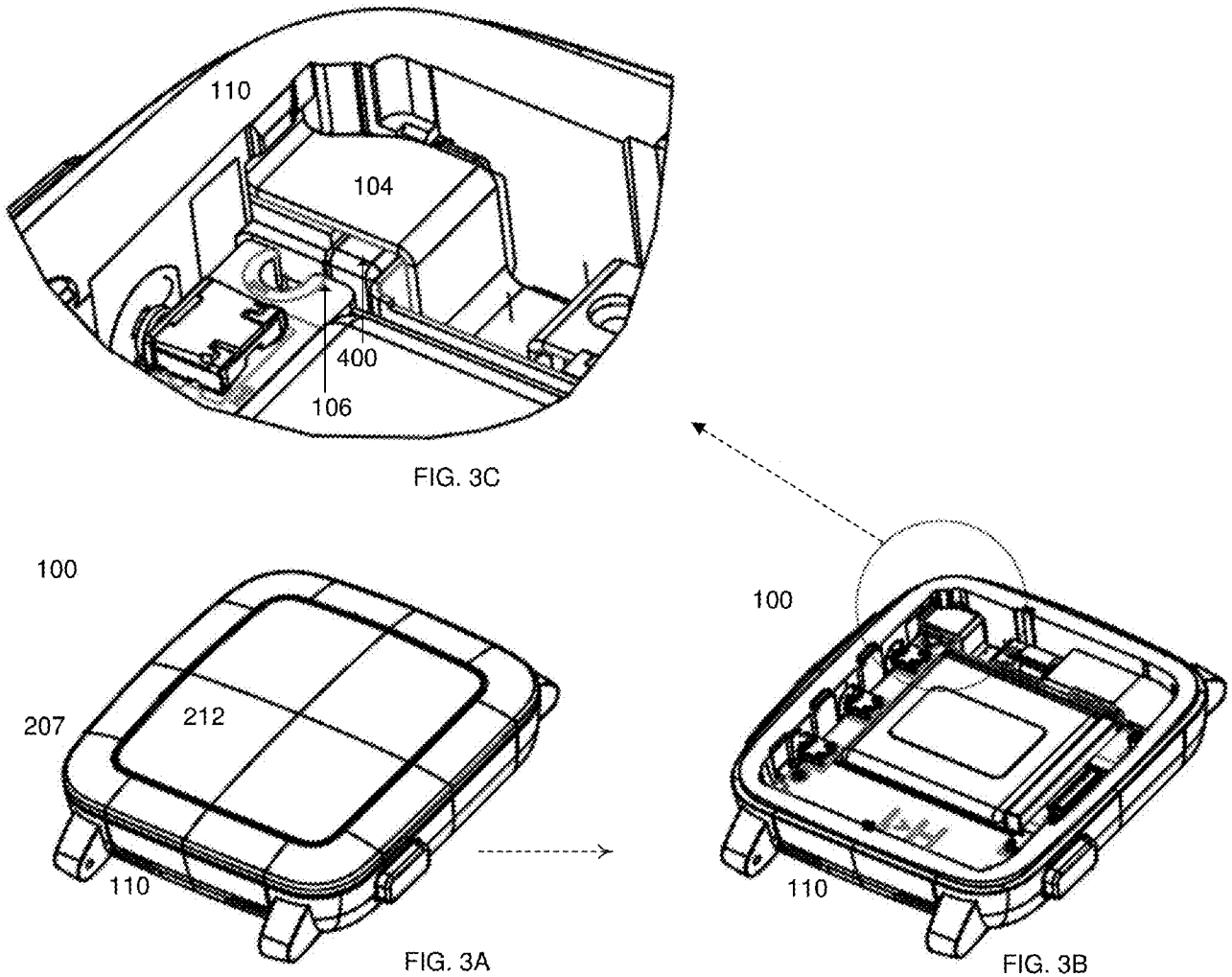
FIGS. 3A-3C illustrate a top-down view of an embodiment of the interior of the housing where the bracket compresses down on the combination of the microphone seal component with its one or more channels and the waterproof material to be pressed against the housing forming the watertight seal.

FIGS. 3A-3C illustrate a top-down view of the interior of the housing where the bracket compresses down on the combination of the microphone seal component with its one or more channels and the waterproof material to be pressed against the housing forming the watertight seal. FIG. 3A shows the wearable electronic device 100 as a seal unit with the bezel 207 and display screen 212 coupled to the housing 110. FIG. 3B shows the wearable electronic device 100 with the top half removed to show the bracket and microphone seal component. FIG. 3C shows a magnified view the wearable electronic device 100 the bracket 104 compressing down on the combination of the microphone seal component 104 and the waterproof material 106 against the housing 110. The bracket 104 provides compression to the stacked layers to generate waterproofing for the microphone hole penetrating the housing. Underneath the bracket and microphone seal component would be the microphone. Each channel is cut or molded into the microphone seal component below the surface level of the face of the rest of the microphone seal component such that when compressed there's always an air equalization path between an internal housing pressure and the external atmospheric pressure while still maintaining a waterproofing characteristic of the electronic device up to 3 atms. In alternative embodiments, the microphone seal component may be waterproof and/or water resistant up to 1 atm, 2 atms, 4 atms, 5 atms or more or more or waterproof and/or water resistant to level 1 of the IPX liquid intrusion table, level 2, level 3, level 4, level 5, level 6, level 7, level 8 or up to level 9K.

In an embodiment, the microphone connects to the housing 110 through the microphone seal component 400 with the one or more channels 408 and through the waterproof material 106. The waterproof material 106 covers an opening inside the housing at a location 102 where the microphone hole penetrates the housing. The waterproof material 106 is made of a composite fabric with a gas permeable membrane to repel water molecules up to a pressure of at least three atmospheres of water pressure while allowing smaller molecules than water, and sound waves in air, to pass through the waterproof material.

Figure 4A:
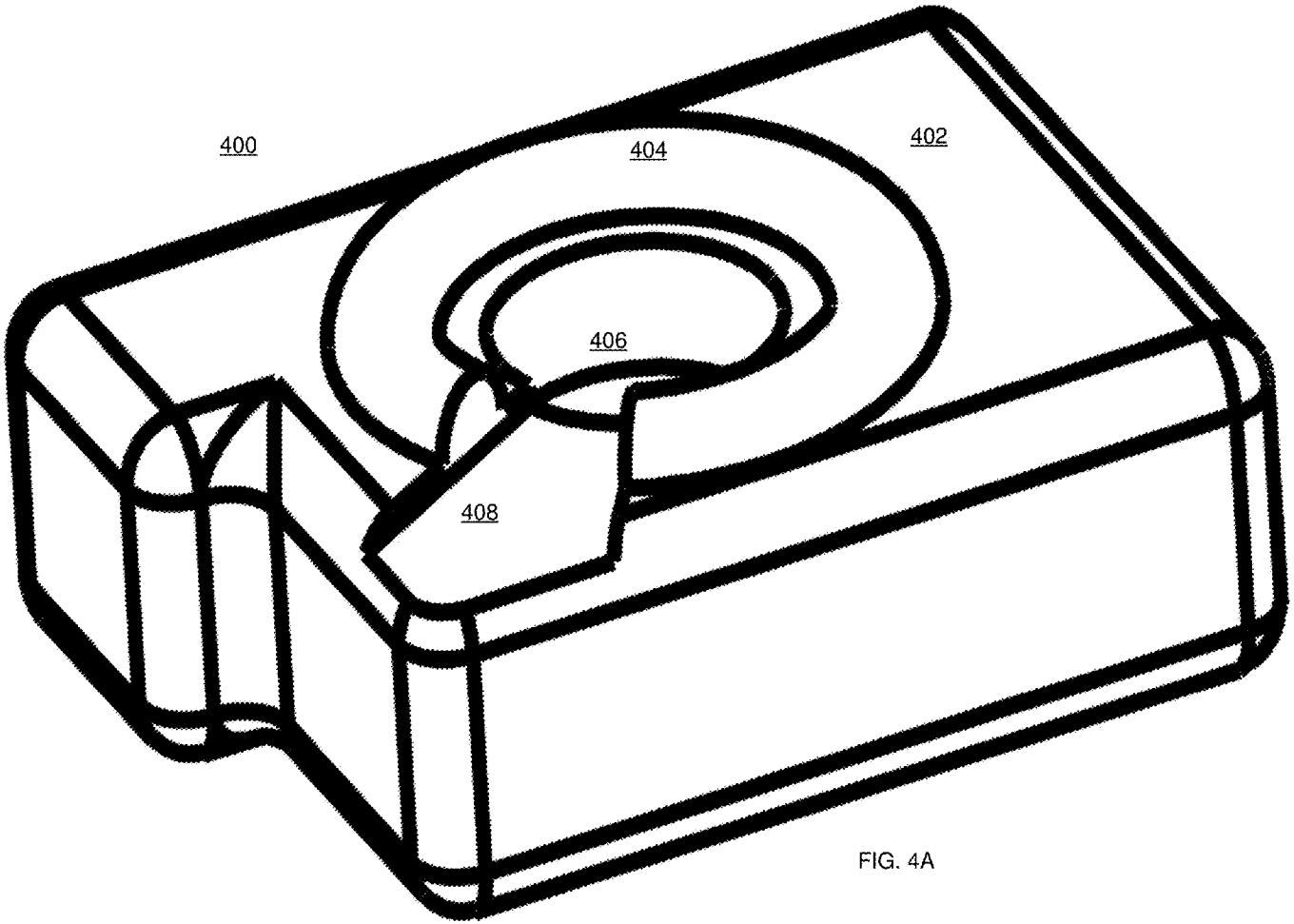
FIGS. 4A-4B illustrates a diagram of an embodiment of a microphone seal component with one or more channels and one or more gaps in the raised portion.
Figure 4B:
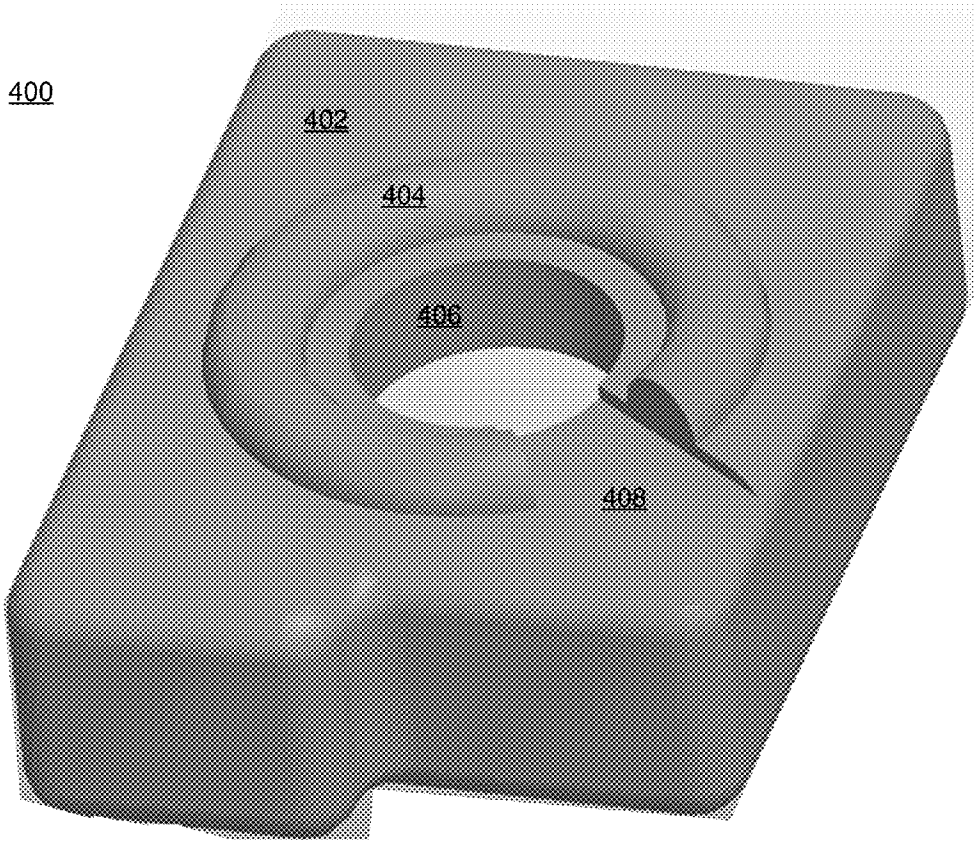

FIGS. 4A-4B illustrate diagrams of an embodiment a microphone seal component with one or more channels and one or more gaps in the raised portion. The microphone seal component has a front face with a fairly level surface on a first portion, a raised portion in a shape of an O-ring or some other gasket shape on a second portion of the front face, one more channels that are cut or molded into the fairly level surface first portion of the face, and then a center hole formed in the microphone seal component. In an embodiment, the face of the seal has an essentially flat surface level; and thus, the raised portion of the microphone seal component actually is a molded depression so the raised O-ring portion can fit into the depression in the molded microphone seal component.

The O-ring shaped raised material on the surface of the microphone seal component is made such that it has one or more gaps in that raised surface forming the O-ring. The one or more breaks or gaps are located in the raised surface forming the O-ring gasket of the microphone seal component. Each gap or break in the raised surface is correspondingly located to lead into the one or more channels or grooves that were molded or cut into the microphone seal component.

The depth of the channel goes below the surface level of the face of the microphone seal component. The channel depth of the channel may extend completely through the microphone seal component, and is either molded originally in that shape or die cut out of the microphone seal component. Alternatively, the depth of the channel may be as shallow as to only go down a small fraction of an inch below the surface level of the face of the microphone seal component into the molded microphone seal component. The dimensions of the depth, width and shape of the one or more channels correspond to the type of microphone inside the housing of the electronic device. The depth, width, and shape of the channel are designed to provide an optimum or best audio characteristics for the incoming sound waves for the corresponding type of microphone inside the housing of the electronic device. The audio performance characteristics of sound waves coming through the microphone hole coupled to this microphone seal component determine the dimensions of the channel. The depth, width, and shape of the channel are created to provide at least a minimum acceptable audio performance design specifications set by a manufacturer for the corresponding type of microphone installed inside the housing of the electronic device. For example, the shape of the channel may be rectangular, semi-circular, or other. The depth and width of the channel are set in dimensions such that under maximum design compression of the housing an air relief pathway still exists so that pressure equalization can occur between the internal pressure inside the housing and the atmospheric pressure external to the housing. The depth and width of the channel are set in dimensions such that when in cooperation with the waterproof material the device is still waterproof for at least three atms of water pressure.

In an embodiment, the channels 408 in the microphone seal component 400 cooperate with the waterproofing material 106 to act as a pressure relief pathway and pressure equalization mechanism to help alleviate any deformation of the bezel and display screen when exposed to expansion stresses as well as reduce the expansion and contraction cycling of the pliable sealing substrate. In an example, the pliable sealing substrate may have on both sides adhesive tape like substance to join the two halves of the housing of the electronic device together.

Therefore, the microphone seal component 400 has a front face with a fairly level surface 402 on a first portion, a raised portion 404 in a shape of an O-ring or some other gasket shape on a second portion of the front face. The one more channels 408 may be cut or molded into the fairly level surface first portion of the face, and then a center hole 406 is formed in the microphone seal component.

In an embodiment, the gasket or O-ring shaped raised material 404 on the surface of the microphone seal component 400 is made such that it has one or more gaps in that raised surface forming the O-ring or gasket. The one or more gaps in the raised surface correspond to the locations leading to the channels 408 can also be molded or cut into the microphone seal component.

In an embodiment, the location of the gaps in the raised surface 404 of the microphone seal component and corresponding channels 408 in the front face are positioned to correspond with the type of microphone installed in the housing in order to obtain an optimum audio characteristics for sound waves coming in through the microphone hole. The waterproof material and the microphone seal component assist to form the water tight seal up to at least two atms for the microphone hole 102 penetrating the housing. In alternative embodiments, the microphone seal component may be waterproof and/or water resistant up to 1 atm, 3 atms, 4 atms, 5 atms or more or waterproof and/or water resistant to level 1 of the IPX liquid intrusion table, level 2, level 3, level 4, level 5, level 6, level 7, level 8 or up to level 9K. Thus, in an embodiment, the watertight seal may be waterproof and/or water resistant.

The depth of the first channel 408 goes below the surface level 402 of the face of the microphone seal component 400. The dimensions of the depth, width and shape of the one or more channels correspond to the particular type of the microphone that happens to be installed inside the housing of the electronic device. The depth, width, and shape of the first channel are created to provide at least a minimum acceptable audio performance design specification set by a manufacturer for the corresponding particular type of microphone installed inside the housing of the electronic device. Each channel may a similar depth, width, and shape. A surface of the channel is generally substantially smooth where notched surfaces are eliminated in the channel. Notched surfaces can significantly degrade a quality of the audio sound waves coming into and through a pathway of the microphone hole 102 into the microphone 108. A loss of three decibels or more could be considered a significant degradation of the audio sound.

In an embodiment, a depth of a first channel extends completely through the microphone seal component 400 and the first channel is die cut out of the microphone seal component.

Also, a depth of a first channel can go below the surface level 402 of the face of the microphone seal component 400. The dimensions of the depth, width and shape of the one or more channels are cut or molded such that under maximum design compression of the housing an air relief pathway still exists such that pressure equalization can occur between the internal pressure inside the housing and the atmospheric pressure external to the housing.

In an embodiment, microphone seal component may be made out of a standard rubber or other gasket material. The channels correspond to the break or gap in the raised doughnut or O-ring surface of the microphone seal component and allow an air equalization path between the internal pressure of the housing of the electronic device and external pressure of the atmosphere.

In an embodiment, the gaps in the raised surface 404 of the microphone seal component 400 and corresponding channels 408 in the face are positioned correspond to a type of microphone installed in the housing such that an optimum audio characteristics for sound waves coming in through the microphone hole is obtained.

The characteristics that would not be acceptable in the channel 408 include creating notches or uneven surfaces in the channel. The surface of the first channel is substantially smooth where notched surfaces are eliminated in the channel, which could significantly degrade a quality of the audio sound waves coming into and through a pathway of the microphone hole into the microphone. In an embodiment, uneven surfaces and notches can cause the sound waves to reflect or redirect and cause a reduction of more than three dB in the strength of the incoming sound wave due to the conditions of the channel that can significantly degrade the quality of the audio sound waves. In an embodiment, the microphone hole and the waterproof seal for that hole formed by the waterproof material compressed by the microphone seal component still forms a portion of the waveguide for the sound waves in air traveling to get to the microphone located inside the electronic housing.

In an embodiment, each break in the raised surface of the microphone seal component corresponds to its own channel. The gaps or breaks in the raised surface of the microphone seal component and corresponding channels in the face are created relative to a type of microphone installed in the housing in order to obtain an optimum audio characteristics for sound waves coming in through the microphone hole. As shown in this example embodiment of FIG. 4, locating the break in the raised surface forming the O-ring gasket and then placing the corresponding channel or groove in the molded microphone seal component should be located roughly at about the 4 o'clock position for an example type of microphone located inside the electronic devices housing.

The O-ring is raised from the general surface level of the face of the microphone seal component. The molded O-ring raise surface is formed as part of the microphone seal component. However, a groove may also be formed in the microphone seal component and an O-ring can be inserted in that groove.

Note, the design is contrary to a typical thinking that the face of the microphone seal component needs to be completely level in order to keep water from penetrating into the interior of the housing. Instead, the microphone seal component has one or more channels formed into the face portion of the microphone seal component to allow the internal air pressure to equalize by the air flowing through the channels and the waterproofing material out the microphone hole. In addition, the channels can sometimes allow sound to reach other areas within the housing other than the microphone. This also goes against traditional thinking.

As described, the channels are cut or molded into the microphone seal component that has a shape and depth to maintain the audio performance of incoming sound waves conducted through the pathway of the microphone hole, at or above an audio performance level required by the microphone located inside the electronic device. The channels in the face of the microphone seal component in combination with the waterproof material create an air pressure equalization mechanism that still maintains audio performance required by the microphone located inside the housing. Also, locating the air pressure equalization mechanism at an existing hole penetrating in the housing, such as the microphone hole 102, minimizes the number of holes made in the casing of the housing.

Figure 5:
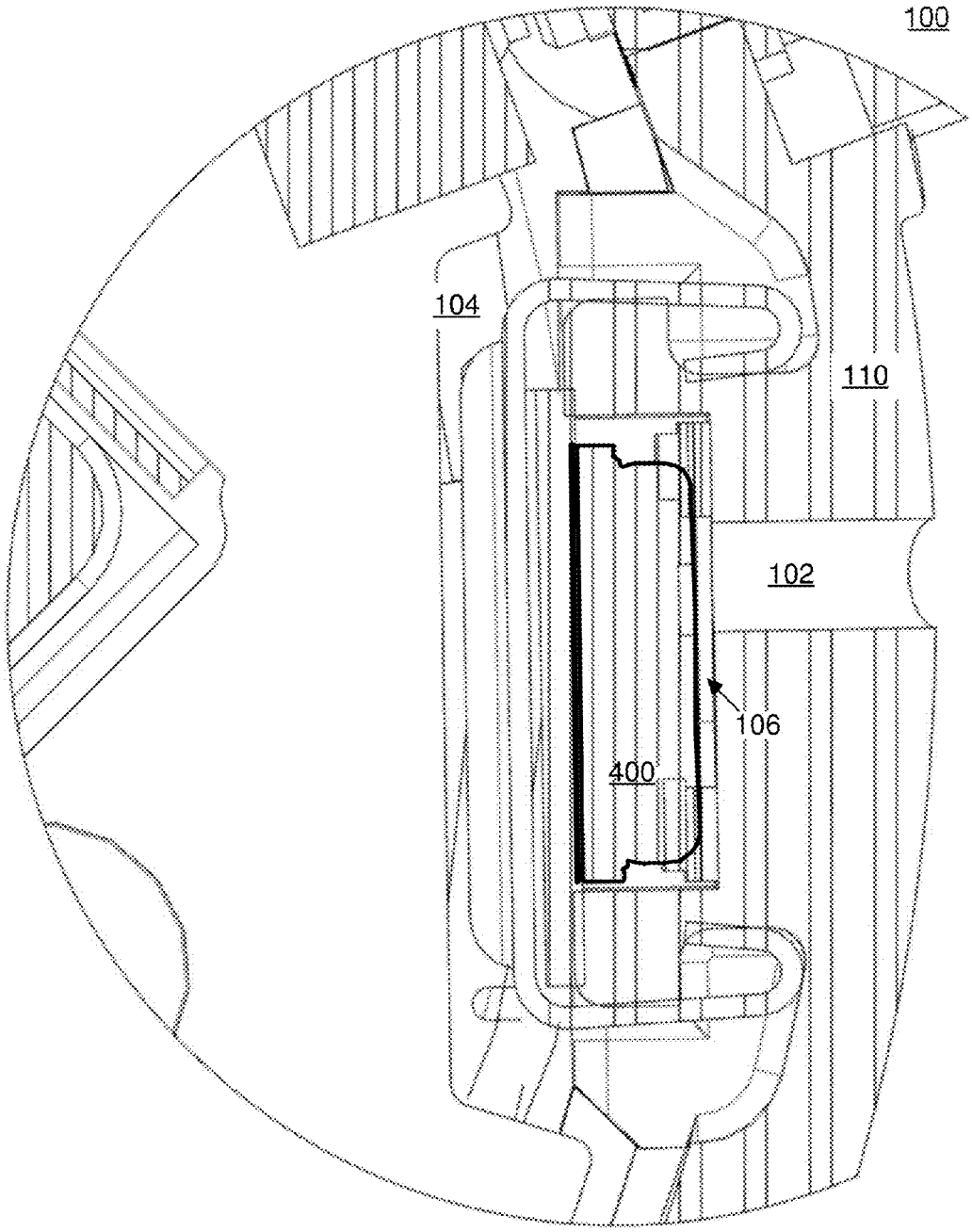
FIG. 5 shows an isolation view of the waterproof material, the pliable sealing substrate, the microphone hole, and the microphone seal component darkened for illustration purposes.

FIG. 5 shows an isolation view of the waterproof material, the pliable sealing substrate, the microphone hole, and the microphone seal component darkened for illustration purposes. In an embodiment, the microphone connects to the housing through the microphone seal component 400 with the one or more channels 408 and through the waterproof material 106. The waterproof material 106 covers an opening 102 inside the housing at a location where the microphone hole 102 penetrates the housing. The waterproof material is made of a composite fabric with a gas permeable membrane to repel water molecules up to a pressure of at least three atmospheres of water pressure in an embodiment while allowing smaller molecules than water as well as sound waves in air, to pass through the waterproof material 106.

As described, the microphone seal component 106 seals the electronic housing at the microphone hole to be waterproof and/or water resistant while still allowing a pressure relief path via the channels being one or more air pressure relief valve's while still maintaining at least a minimum audio performance of the device defined by the specification for the particular type of microphone located inside the electronic device.

Typically, the diameter for the microphone hole as well as the minimum audio performance or characteristics of sound waves for the microphone are specified by the microphone company and its design specs. The dimensions of the channels are designed to be deep enough and wide enough to allow an air relief path for equalization. The dimensions of the channels are designed to be smooth enough and properly located relative to the microphone inside the housing to maintain a minimum audio wavelength quality for the specific microphone in the wearable electronic device. Thus, the design maintains a minimum audio wavelength quality typically set by the manufacturer of the microphone, and still retain the waterproof and/or water resistant nature of the electronic device.

Therefore, the microphone seal component with one or more channels maintains audio functionality for microphone as well as both maintains waterproofing and/or water resistance and air pressure equalization when pressed against the waterproofing material. The waterproofing material combines with the microphone seal component and the compression of the bracket 104 to form a waterproof seal up to 3 to 5 atms and prevents water from entering into the interior of the housing while allowing soundwaves in air to penetrate. The shape of the channel ensures that the audio characteristics of those sound waves are maintained at or above a minimum standard required by the microphone located inside the electronic housing.

In various embodiments, the combination of sealing components, microphone sealing component, waterproofing material, and sealants used on the housing casing can make the resulting device water resistant to level 1 of the IPX liquid intrusion table, level 2, level 3, level 4, level 5, level 6, level 7, level 8 or up to level 9K.

IPX Liquid Intrusion Table

| Level | Protected against | Effective against | Details |
|---|---|---|---|
| 0 | Not protected | . . . | . . . |
| 1 | Dripping water | Dripping water (vertically falling drops) shall have no harmful effect. | Test duration: 10 minutes<br>Water equivalent to 1 mm rainfall per minute |
| 2 | Dripping water when tilted up to 15° | Vertically dripping water shall have no harmful effect when the enclosure is tilted at an angle up to 15° from its normal position. | Test duration: 10 minutes<br>Water equivalent to 3 mm rainfall per minute |
| 3 | Spraying water | Water falling as a spray at any angle up to 60° from the vertical shall have no harmful effect. | Test duration: 5 minutes<br>Water volume: 0.7 liters per minute<br>Pressure: 80-100 kPa |
| 4 | Splashing of water | Water splashing against the enclosure from any direction shall have no harmful effect. | Test duration: 5 minutes<br>Water volume: 10 liters per minute<br>Pressure: 80-100 kPa |
| 5 | Water jets | Water projected by a nozzle (6.3 mm) against enclosure from any direction shall have no harmful effects. | Test duration: at least 3 minutes<br>Water volume: 12.5 liters per minute<br>Pressure: 30 kPa at distance of 3 m |
| 6 | Powerful water jets | Water projected in powerful jets (12.5 mm nozzle) against the enclosure from any direction shall have no harmful effects. | Test duration: at least 3 minutes<br>Water volume: 100 liters per minute<br>Pressure: 100 kPa at distance of 3 m |
| 6K | Powerful water jets with increased pressure | Water projected in powerful jets (6.3 mm nozzle) against the enclosure from any direction, under elevated pressure, shall have no harmful effects. | Test duration: at least 3 minutes<br>Water volume: 75 liters per minute<br>Pressure: 1000 kPa at distance of 3 m |
| 7 | Immersion up to 1 mm | Ingress of water in harmful quantity shall not be possible when the enclosure is immersed in water under defined conditions of pressure and time(up to 1 m of submersion). | Test duration: 30 minutes<br>Tested with the lowest point of the enclosure 1000 mm below the surface of the water, or the highest point 150 mm below the surface, whichever is deeper. |
| 8 | Immersion beyond 1 m | The equipment is suitable for continuous immersion in water under conditions which shall be specified by the manufacturer. However, with certain types of equipment, it can mean that water can enter but only in such a manner that it produces no harmful effects. | Test duration: continuous immersion in water<br>Depth specified by manufacturer, generally up to 3 m |
| 9K | Powerful high temperature water jets | Protected against close-range high pressure, high temperature spray downs. | Test duration: —<br>Water volume: 14~16 liters per minute<br>Pressure: (18000~10000 kPa/ 80~100 Bar) at distance of 0.1~0.15 cm<br>Water temperature: 80° C. |

In an embodiment, other components can be used to allow air equalization between an internal pressure of the wearable electronic device and atmospheric pressure through existing holes in the casing of the electronic device. For example, a flapper valve and/or a check valve may be used as an air equalization mechanism that flows through the waterproof material and its gas permeable membrane.

Thus, the design takes advantage of using an existing hole in the casing that is waterproof and now adds in the functionality of air pressure equalization via channels cut into or molded into the microphone seal component. In some embodiments, the channels and cuts in the microphone seal component can be used with other existing penetrations in holes in the housing of the electronic device to allow airwaves to pass through and providing an air equalization path between the internal pressure and the external atmospheric pressure. The waterproof material in combination with the microphone seal component or another similar component provides dual functionality of keeping the electronic device water resistant up to 3 atms and allowing air waves to penetrate through the housing to their sensing, e.g., microphone, components. In alternative embodiments, the entire electronic device may be waterproof and/or water resistant up to 1 atm, 2 atms, 4 atms, 5 atms or more or waterproof and/or water resistant to level 1 of the IPX liquid intrusion table, level 2, level 3, level 4, level 5, level 6, level 7, level 8 or up to level 9K.

Figure 6:
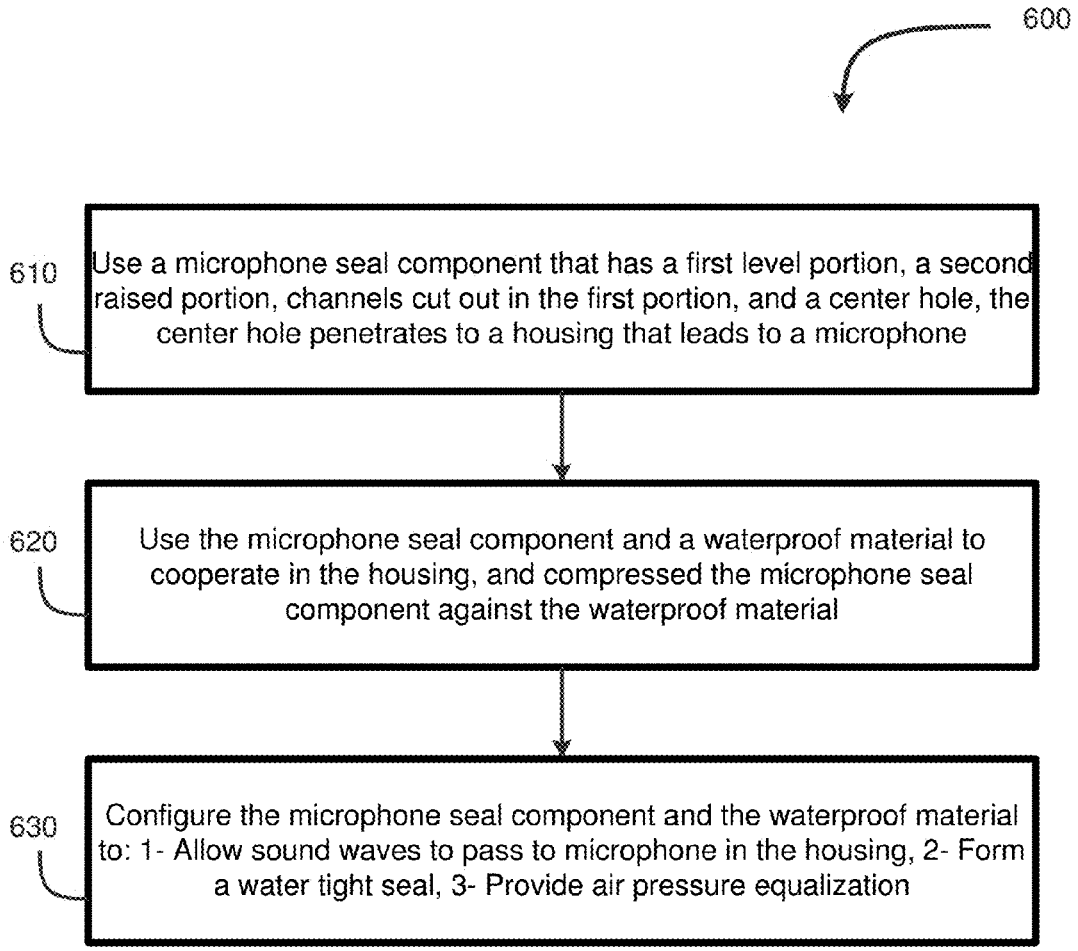
FIG. 6 illustrates a flow graph of an example method to make waterproof and/or water resistant a microphone hole of an embodiment of a wearable electronic device while also providing an air pressure equalization pathway.

FIG. 6 illustrates a flow graph of an example method to make waterproof and/or water resistant a microphone hole of a wearable electronic device while also providing an air pressure equalization pathway. The flow diagram 600 can be used for describing the method and the steps may be performed out of literal order when logically possible. A microphone seal component is used to make the microphone hole of a wearable electronic device waterproof and/or water resistant. The microphone seal component has a first level portion, a second raised portion, channels cut out in the first portion, and a center hole. The center hole penetrates to a housing that leads to the microphone (610). FIGS. 4A and 4B show the fairly level front face 402 of the microphone seal component 400. A raised portion 404 in the shape of an O-ring or gasket is on the front face. The center hole 406 is cut out through the microphone seal component. Also shown in FIGS. 4A and 4B is the channel 408 cut out in the first portion. In an example, only the first portion is cut out and the second portion is an O-ring with one gap. In another example, in channel 408 both the first portion and the second portion are cut out.

In an embodiment, the channel 408 is cut out all the way through the first portion. In another example, the channel 408 is partially cut out through the first portion. In another example, the cut out channel is at least partially filled with waterproof material.

The microphone seal component and a waterproof material are used to cooperate in the housing such that the microphone seal component is pressed against the waterproof material (620). As shown in FIG. 1, the microphone seal component 400 and a waterproof material 106 cooperate with each other in the housing 110 such that they are pressed against each other to make the housing 110 water proof.

The microphone seal component and the waterproof material are configured together to: 1—Allow sound waves to pass to microphone in the housing, 2—Form a water tight seal, 3—Provide air pressure equalization (630). The microphone seal component 400 has one or more channels 408 such that when compressed against the waterproof material 106 the combination of the microphone seal component pressed to the waterproof material can provide multiple functions to allow sound waves in air 101 to pass through microphone hole 102 to the microphone located inside the housing 110 behind the waterproof material 106 and the microphone seal component. The combination while assisting to form a water tight seal up to at least 3 atms for the microphone hole 102 penetrating the housing 110, providing an air pressure equalization mechanism between an internal pressure inside the housing 110 of the electronic device and atmospheric pressure external to the housing of the electronic device. In alternative embodiments, the electronic device may be waterproof and/or water resistant up to 1 atm, 2 atms, 4 atms, 5 atms or more or waterproof and/or water resistant to level 1 of the IPX liquid intrusion table, level 2, level 3, level 4, level 5, level 6, level 7, level 8 or up to level 9K.

Figure 9:
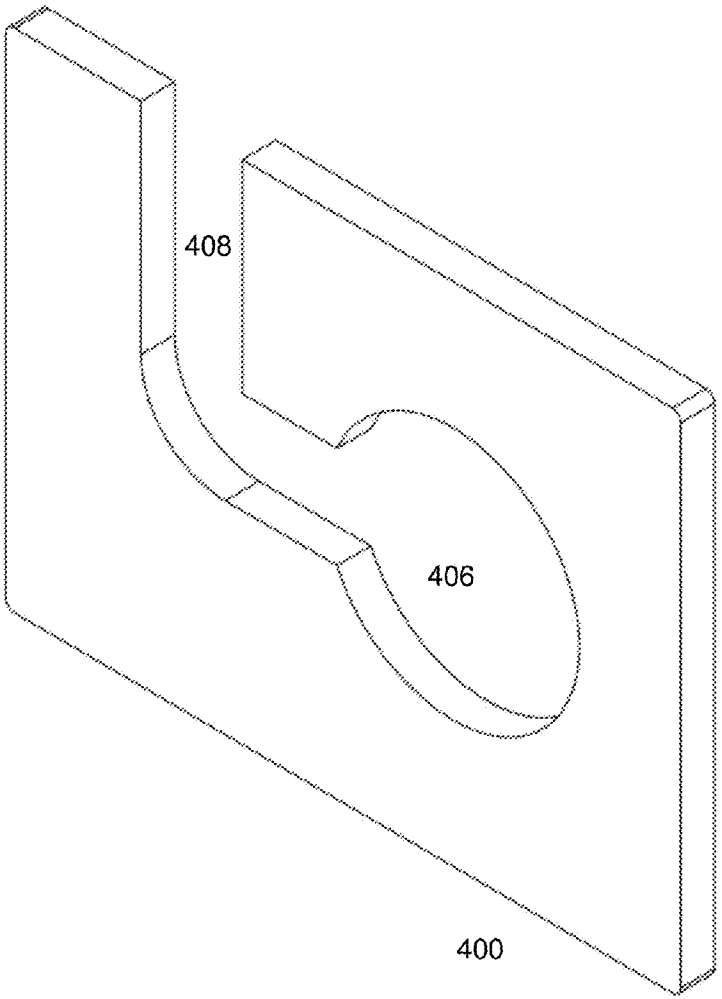
FIG. 9 illustrates a block diagram of an embodiment of the depth of an example channel extending completely through the microphone seal component.

FIG. 9 illustrates a diagram of an embodiment of the depth of an example channel 408 extending completely through the microphone seal component 400. The microphone seal component 400 may have a fairly flat surface with the center hole 406 and channel(s) 408 molded or cut out.

Figure 10:
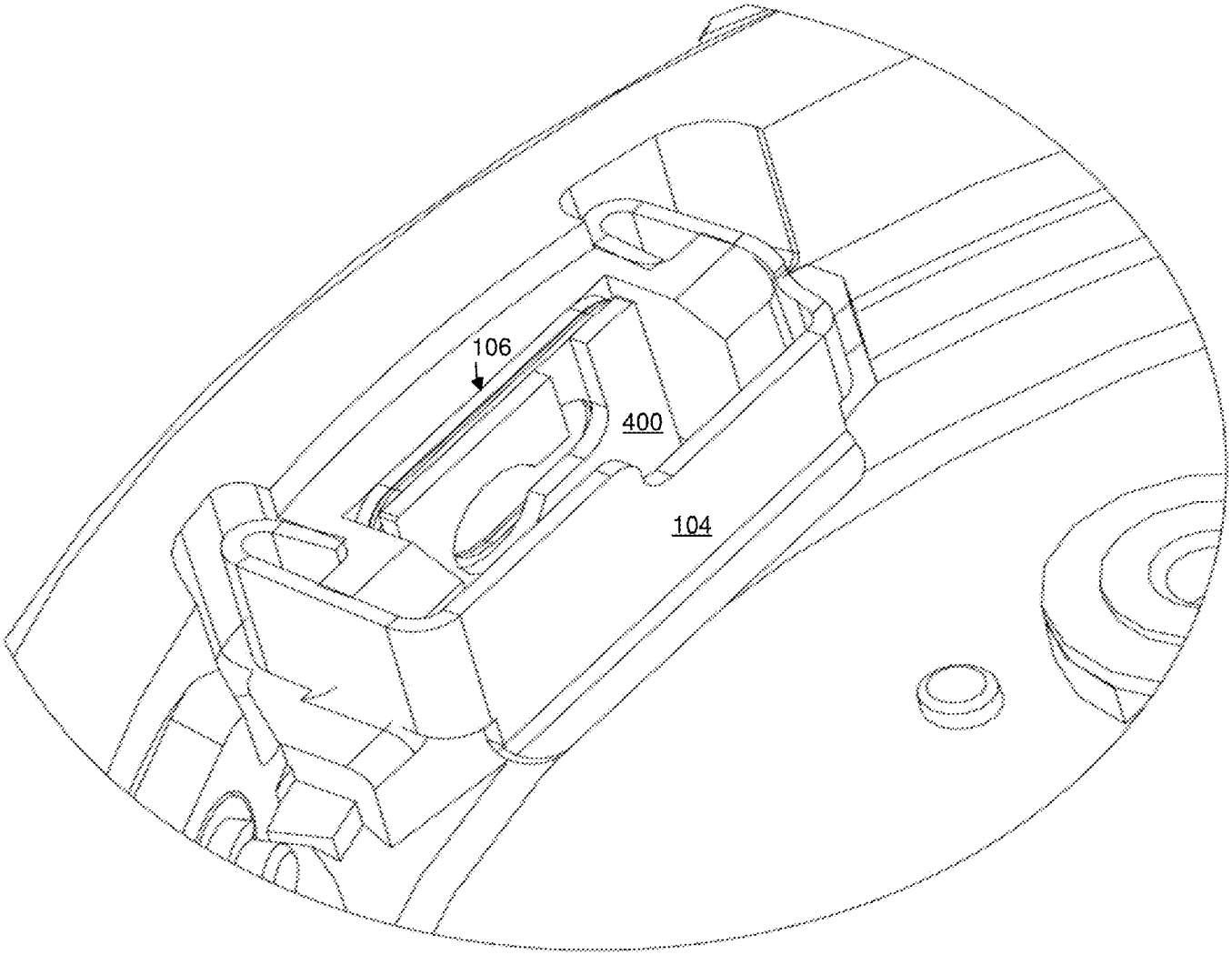
FIG. 10 illustrates a view of an embodiment of the interior of the housing where the bracket compresses down on the combination of the microphone seal component with its one or more channels and the waterproof material to be pressed against the housing forming the watertight seal.

FIG. 10 illustrates a view of an embodiment of the interior of the housing where the bracket 104 compresses down on the combination of the microphone seal component 400 with its one or more channels and the waterproof material 106 to be pressed against the housing forming the watertight seal. Each channel 408 may be die cut out of the microphone seal component 400. Two or more microphone seal components 400 may stack against each other.

In an embodiment, the wearable electronic device is a smart watch which features a black and white Sharp Memory LCD display screen, a programmable CPU, memory, storage, Bluetooth, a vibrating motor, a magnetometer, an ambient light sensor, and an accelerometer. These features extend the smart watch's use beyond just displaying the time on the display screen and into many roles including interacting with smartphone notifications, activity tracking, gaming, map display, golf tracking, and more. The smart watch is compatible with Android and iOS devices. When connected to one of these devices via Bluetooth, the smart watch can (but may not need to) pair with that device and vibrate and display text messages, fitness information, emails, incoming calls, and notifications from social media accounts. The smart watch can also act as a remote control for the telephone function in the paired device, or for other paired devices containing a camera such as the GoPro. As an example, the Pebble app store can provide a software development kit (SDK) to develop application as well as over 9,500 developed applications and watchfaces.

Figure 7:
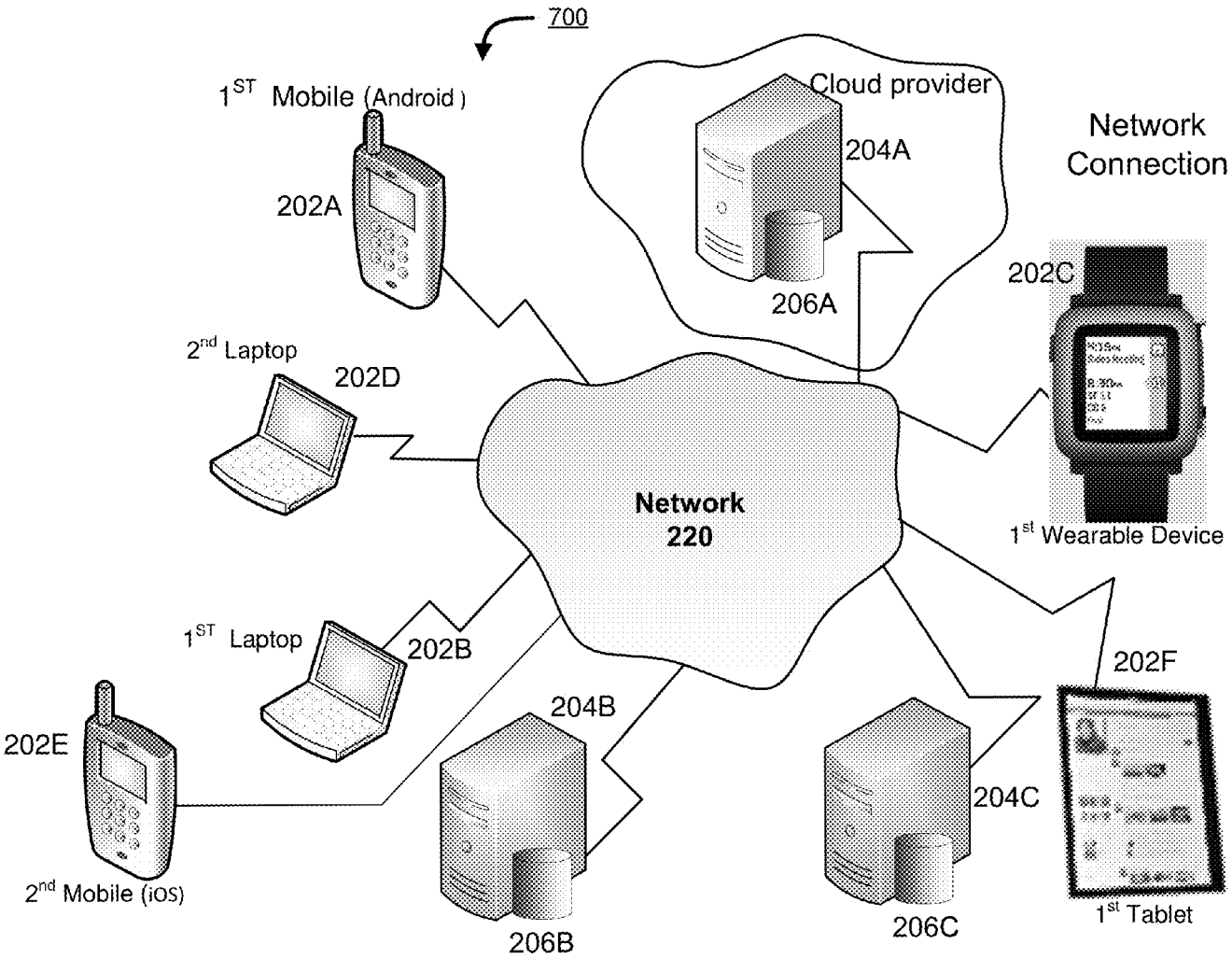
FIG. 7 illustrates a block diagram of an embodiment of remote access and/or communication by a wearable device to other devices on a network.
Figure 8:
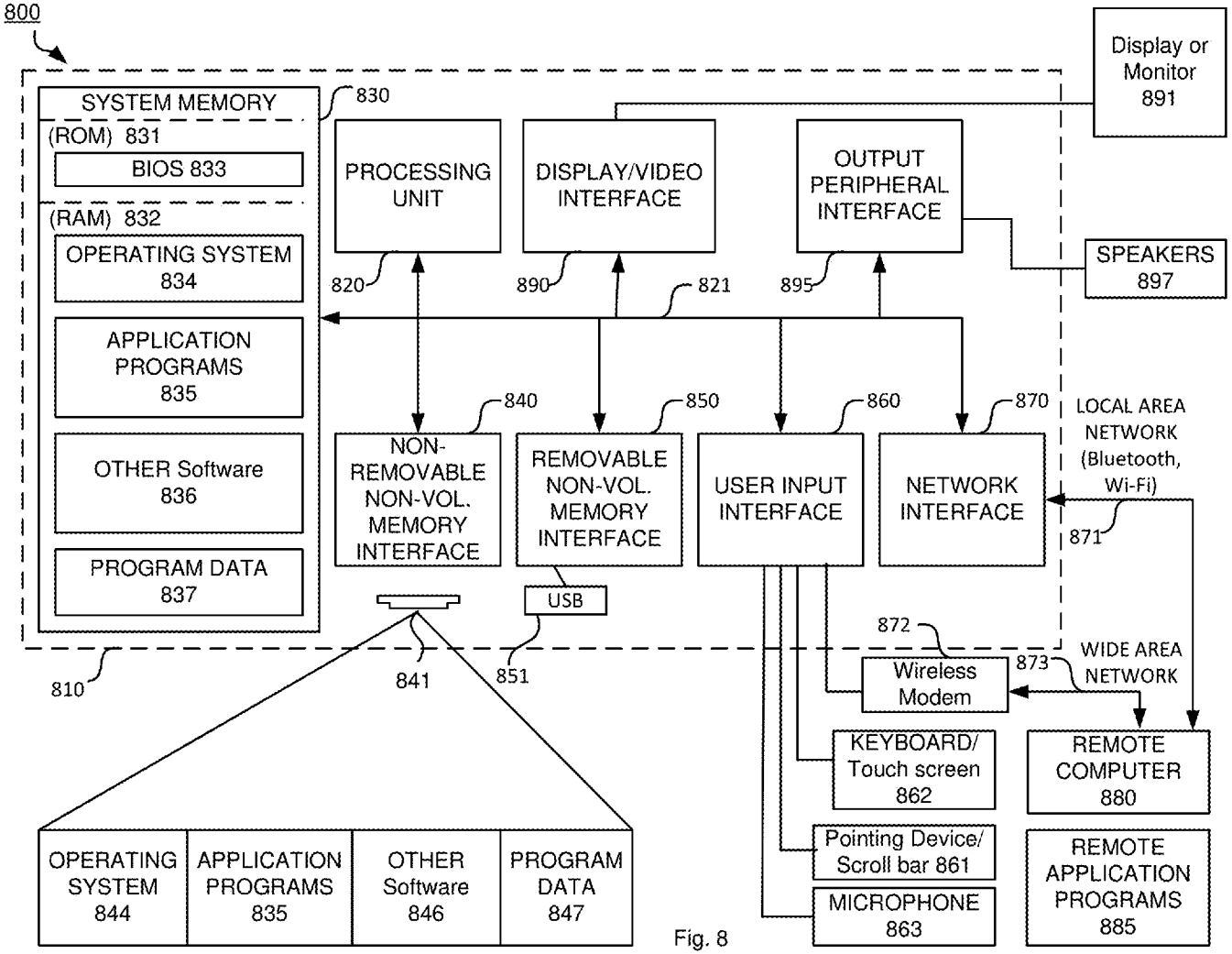
FIG. 8 illustrates a block diagram of an example computing system that may be part of an embodiment of one or more of the wearable devices discussed herein.

In general, the wearable electronic device includes one or more systems and can be coupled to one or more networks. FIGS. 7-8 illustrates additional example environments to implement the concepts. The housing also has a computer readable storage medium in the housing accessible to the processor for storing instructions executable by the processor to generate the number of different operations on the onscreen display.

FIG. 8 illustrates a block diagram of an example computing system that may be used in an embodiment of one or more of the servers, a wearable electronic device, and client devices discussed herein. The computing system environment 800 is only one example of a suitable computing environment, such as a client device, server, wearable electronic device, etc., and is not intended to suggest any limitation as to the scope of use or functionality of the design of the computing system 810. Neither should the computing environment 800 be interpreted as having any dependency or requirement relating to any one or combination of components illustrated in the exemplary operating environment 800.

In an embodiment, the wearable electronic device is an electronic smartwatch that comes with a Gorilla Glass 64-color LED e-paper display, with 144×168 pixels and a pixel density of 182 ppi. The wearable electronic device has a color display, and still retains a backlight as well. The wearable electronic device also has a vibrating motor for silent alarms, and smart notifications. The wearable electronic device can have a redesigned charging cable that can magnetically attaches itself to the wearable electronic device in order to maintain its water resistance. The wearable electronic device can also be equipped with an ambient light sensor, 6 axis accelerometer, and etc. In an example, the wearable electronic device can have axis accelerometer with gesture detection, a vibrating motor, an ambient light sensor, a compass, a gyrometer, a magnetometer, a pedometer, a microphone, and four physical buttons for user input. In alternative embodiments, the display may include a touch screen, a scroll bar, a rotating bezel or a combination of any of the elements for user input.

In an example, the display can have 144×168 pixel Sharp Memory LCD "e-paper", or 144×168 pixel black and white memory LCD using an ultra low-power "transflective LCD" manufactured by, for example, Sharp with a backlight, or 1.25 inch 64-color LED backlit e-paper display.

In an embodiment, the wearable electronic device can connect through a wireless network to an app store having over 9,500 applications and watchfaces that can be downloaded. The applications include notifications for emails, calls, text messages & social media activity; stock prices; activity tracking (movement, sleep, estimates of calories burned); remote controls for smartphones, cameras & home appliances; turn-by-turn directions (using the GPS receiver in a smartphone or tablet); display of RSS or JSON feeds; and also include hundreds of custom watch faces.

In an embodiment, the wearable electronic device can originally be shipped with applications pre-installed. These applications can use data received from a connected phone for distance, speed and range information. The applications can also directly connect to a backend server on the cloud. More applications are downloadable via a mobile phone or tablet, and an SDK is freely available.

In an embodiment, the wearable electronic device can integrates with any phone or tablet application that sends out native iOS or Android notifications.

In an embodiment, the wearable electronic device's firmware operating system is based on a Free RTOS kernel and uses Newlib, the STM32 Peripheral Lib, the Ragel state machine compiler, and a UTF-8 Decoder. As an example, the wearable electronic device includes a 64-color e-paper display with Gorilla Glass, a thinner and more ergonomic chassis, plastic casing and a microphone. In an example, the wearable electronic device can have a Marine Grade steel chassis encasing with bezel and a PVD matte polishing finish and a tough 2.5 D color e-paper display.

In an embodiment, the wearable electronic device is an electronic watch and includes a small accessory port on the back of the watch face. Open hardware platform of the wearable electronic device lets developers develop new third-party straps that connects to a special port at the back of the watch and can add additional features like GPS, heart rate monitors, extended battery life and other things to the watch. It enables the wearer to attach additional equipment to the watch, including sensors, batteries, etc.

Computing System

With reference to FIG. 8, components of the computing system 810 may include, but are not limited to, a processing unit 820 having one or more processing cores, a system memory 830, and a system bus 821 that couples various system components including the system memory to the processing unit 820. The system bus 821 may be any of several types of bus structures including a memory bus or memory controller, a peripheral bus, and a local bus using any of a variety of bus architectures. By way of example, and not limitation, such architectures include Industry Standard Architecture (ISA) bus, Micro Channel Architecture (MCA) bus, Enhanced ISA (EISA) bus, Video Electronics Standards Association (VESA) locale bus, and Peripheral Component Interconnect (PCI) bus.

Computing system 810 typically includes a variety of computing machine-readable media. Computing machine-readable media can be any available media that can be accessed by computing system 810 and includes both volatile and non-volatile media, removable and non-removable media. By way of example, and not limitation, computing machine-readable mediums uses include storage of information, such as computer readable instructions, data structures, other executable software or other data. Computer storage mediums include, but are not limited to, RAM, ROM, EEPROM, flash memory or other memory technology, CD-ROM, digital versatile disks (DVD) or other optical disk storage, magnetic cassettes, magnetic tape, magnetic disk storage or other magnetic storage devices, or any other tangible medium which can be used to store the desired information and which can be accessed by computing device 800. Transitory media such as wireless channels are not included in the machine-readable media. Communication media typically embodies computer readable instructions, data structures, other executable software, or other transport mechanism and includes any information delivery media. As an example, some clients on network 220 of FIG. 7 may not have any optical or magnetic storage.

The system memory 830 includes computer storage media in the form of volatile and/or nonvolatile memory such as read only memory (ROM) 831 and random access memory (RAM) 832. A basic input/output system 833 (BIOS), containing the basic routines that help to transfer information between elements within computing system 810, such as during start-up, is typically stored in ROM 831. RAM 832 typically contains data and/or software that are immediately accessible to and/or presently being operated on by processing unit 820. By way of example, and not limitation, FIG. 8 illustrates that RAM can include a portion of the operating system 834, other executable software 836, and program data 837.

The computing system 810 may also include other removable/non-removable volatile/nonvolatile computer storage media. By way of example only, FIG. 8 illustrates a solid-state memory 841. Other removable/non-removable, volatile/non-volatile computer storage media that can be used in the exemplary operating environment include, but are not limited to, USB drives and devices, flash memory cards, solid state RAM, solid state ROM, and the like. The solid-state memory 841 is typically connected to the system bus 821 through a non-removable memory interface such as interface 840, and USB drive 851 is typically connected to the system bus 821 by a removable memory interface, such as interface 850. In an example, the wearable electronic device can have 128 KB of RAM which can include 84 KB for OS, 24 KB for applications, 12 KB for background worker, and 8 KB for services. The wearable electronic device can have 8 slots for apps/watch faces, with 100 KB per slot for a total of 800 KB user accessible space. In another example, the wearable electronic device can have between 4 MB and 32 Megabits of flash memory.

As an example, the computer readable storage medium 841 stores Operating System software for smart watches to cooperate with both Android OS and iOS.

The drives and their associated computer storage media discussed above and illustrated in FIG. 8, provide storage of computer readable instructions, data structures, other executable software and other data for the computing system 810. In FIG. 8, for example, the solid state memory 841 is illustrated for storing operating system 844, other executable software 846, and program data 847. Note that these components can either be the same as or different from operating system 834, other executable software 836, and program data 837. Operating system 844, other executable software 846, and program data 847 are given different numbers here to illustrate that, at a minimum, they are different copies. In an example, the operating system, Pebble OS, can be a customized Free RTOS kernel that can communicate with Android and iOS apps using Bluetooth.

A user may enter commands and information into the computing system 810 through input devices such as a keyboard, touchscreen, or even push button input component 862, a microphone 863, a pointing device and/or scrolling input component 861, such as a mouse, trackball or touch pad. The microphone 863 may cooperate with speech recognition software. These and other input devices are often connected to the processing unit 820 through a user input interface 860 that is coupled to the system bus, but may be connected by other interface and bus structures, such as a parallel port, game port or a universal serial bus (USB). A display monitor 891 or other type of display screen device is also connected to the system bus 821 via an interface, such as a display and video interface 890. In addition to the monitor, computing devices may also include other peripheral output devices such as speakers 897 and other output device, which may be connected through an output peripheral interface 890.

The computing system 810 may operate in a networked environment using logical connections to one or more remote computers/client devices, such as a remote computing device 880. The remote computing device 880 may be a wearable electronic device, a personal computer, a hand-held device, a server, a router, a network PC, a peer device or other common network node, and typically includes many or all of the elements described above relative to the computing system 810. The logical connections depicted in FIG. 8 include a local area network (LAN) 871 and a wide area network (WAN) 873, but may also include other networks. Such networking environments are commonplace in offices, enterprise-wide computer networks, intranets and the Internet. A browser application may be resident on the computing device and stored in the memory.

When used in a LAN networking environment, the computing system 810 is connected to the LAN 871 through a network interface or adapter 870, which can be a Bluetooth or Wi-Fi adapter. When used in a WAN networking environment, the computing system 810 typically includes a modem 872, e.g., a wireless network, or other means for establishing communications over the WAN 873, such as the Internet. The wireless modem 872, which may be internal or external, may be connected to the system bus 821 via the user-input interface 860, or other appropriate mechanism. In a networked environment, other software depicted relative to the computing system 810, or portions thereof, may be stored in the remote memory storage device. By way of example, and not limitation, FIG. 8 illustrates remote application programs 885 as residing on remote computing device 880. It will be appreciated that the network connections shown are exemplary and other means of establishing a communications link between the computing devices may be used.

As discussed, the computing system may include a processor, a memory, a built in battery to power the computing device, an AC power input to charge the battery, a display screen, a built-in Wi-Fi circuitry to wirelessly communicate with a remote computing device connected to network.

It should be noted that the present design can be carried out on a computing system such as that described with respect to FIG. 8. However, the present design can be carried out on a server, a computing device devoted to message handling, or on a distributed system in which different portions of the present design are carried out on different parts of the distributed computing system.

Another device that may be coupled to bus 811 is a power supply such as a battery and Alternating Current adapter circuit. As discussed above, the DC power supply may be a battery, a fuel cell, or similar DC power source that needs to be recharged on a periodic basis. The wireless communication module 872 may employ a Wireless Application Protocol to establish a wireless communication channel. The wireless communication module 872 may implement a wireless networking standard such as Institute of Electrical and Electronics Engineers (IEEE) 802.11 standard, IEEE std. 802.11-1999, published by IEEE in 1999.

Examples of mobile computing devices may be a wearable electronic device, a laptop computer, a cell phone, a personal digital assistant, or other similar device with on board processing power and wireless communications ability that is powered by a Direct Current (DC) power source that supplies DC voltage to the mobile device and that is solely within the mobile computing device and needs to be recharged on a periodic basis, such as a fuel cell or a battery.

Network Environment

FIG. 7 illustrate diagrams of a network environment in which the techniques described may be applied. The network environment 700 has a communications network 220 that connects server computing systems 204A through 204C, and at least one or more client computing systems 202A to 202F. As shown, there may be many server computing systems 204A through 204C and many client computing systems 202A to 202F connected to each other via the network 220, which may be, for example, the Internet. Note, that alternatively the network 220 might be or include one or more of: an optical network, a cellular network, the Internet, a Local Area Network (LAN), Wide Area Network (WAN), satellite link, fiber network, cable network, or a combination of these and/or others. It is to be further appreciated that the use of the terms client computing system and server computing system is for clarity in specifying who generally initiates a communication (the client computing system) and who responds (the server computing system). No hierarchy is implied unless explicitly stated. Both functions may be in a single communicating device, in which case the client-server and server-client relationship may be viewed as peer-to-peer. Thus, if two systems such as the client computing system 202A and the server computing system 204A can both initiate and respond to communications, their communication may be viewed as peer-to-peer. Likewise, communications between the server computing systems 204A and 204-B, and the client computing systems 202A and 202C may be viewed as peer-to-peer if each such communicating device is capable of initiation and response to communication. Additionally, server computing systems 204A-204C also have circuitry and software to communication with each other across the network 220. One or more of the server computing systems 204A to 204C may be associated with a database such as, for example, the databases 206A to 206C. Each server may have one or more instances of a virtual server running on that physical server and multiple virtual instances may be implemented by the design. A firewall may be established between a client computing system 202C and the network 220 to protect data integrity on the client computing system 202C. Each server computing system 204A-204C may have one or more firewalls.

A cloud provider service can install and operate application software in the cloud and users can access the software service from the client devices. Cloud users who have a site in the cloud may not solely manage the cloud infrastructure and platform where the application runs. Thus, the servers and databases may be shared hardware where the user is given a certain amount of dedicate use of these resources. The user's cloud-based site is given a virtual amount of dedicated space and bandwidth in the cloud. Cloud applications can be different from other applications in their scalability which can be achieved by cloning tasks onto multiple virtual machines at run-time to meet changing work demand. Load balancers distribute the work over the set of virtual machines. This process is transparent to the cloud user, who sees only a single access point.

The cloud-based remote access is coded to utilize a protocol, such as Hypertext Transfer Protocol (HTTP), to engage in a request and response cycle with both a mobile device application resident on a client device as well as a web-browser application resident on the client device. The cloud-based remote access for a wearable electronic device, can be accessed by a mobile device, a desktop, a tablet device, and other similar devices, anytime, anywhere. Thus, the cloud-based remote access to a wearable electronic device hosted on a cloud-based provider site is coded to engage in 1) the request and response cycle from all web browser based applications, 2) SMS/twitter based request and response message exchanges, 3) the request and response cycle from a dedicated on-line server, 4) the request and response cycle directly between a native mobile application resident on a client device and the cloud-based remote access to a wearable electronic device, and 5) combinations of these.

In an embodiment, the server computing system 204A may include a server engine, a web page management component, a content management component, and a database management component. The server engine performs basic processing and operating system level tasks. The web page management component handles creation and display or routing of web pages or screens associated with receiving and providing digital content and digital advertisements. Users may access the server-computing device by means of a URL associated therewith. The content management component handles most of the functions in the embodiments described herein. The database management component includes storage and retrieval tasks with respect to the database, queries to the database, and storage of data.

An embodiment of a server computing system to display information, such as a web page, etc. is discussed. An application including any program modules, when executed on the server computing system 204A, causes the server computing system 204A to display windows and user interface screens on a portion of a media space, such as a web page. A user via a browser from the client computing system 202A may interact with the web page, and then supply input to the query/fields and/or service presented by a user interface of the application. The web page may be served by a web server computing system 204A on any Hypertext Markup Language (HTML) or Wireless Access Protocol (WAP) enabled client computing system 202A or any equivalent thereof. For example, the client mobile computing system 202A may be a wearable electronic device, smart phone, a touch pad, a laptop, a netbook, etc. The client computing system 202A may host a browser to interact with the server computing system 204A. Each application has a code scripted to perform the functions that the software component is coded to carry out such as presenting fields and icons to take details of desired information. Algorithms, routines, and engines within the server computing system 204A take the information from the presenting fields and icons and put that information into an appropriate storage medium such as a database. A comparison wizard is scripted to refer to a database and make use of such data. The applications may be hosted on the server computing system 204A and served to the browser of the client computing system 202A. The applications then serve pages that allow entry of details and further pages that allow entry of more details.

Scripted Code

Any application and other scripted code components may be stored on a non-transitory computing machine-readable medium which, when executed on the machine causes the machine to perform those functions. The applications including program modules may be implemented as logical sequences of software code, hardware logic circuits, and any combination of the two, and portions of the application scripted in software code are stored in a non-transitory computing device readable medium in an executable format. In an embodiment, the hardware logic consists of electronic circuits that follow the rules of Boolean Logic, software that contain patterns of instructions, or any combination of both.

The design is also described in the general context of computing device executable instructions, such as applications etc. being executed by a computing device. Generally, programs include routines, objects, widgets, plug-ins, and other similar structures that perform particular tasks or implement particular abstract data types. Those skilled in the art can implement the description and/or figures herein as computer-executable instructions, which can be embodied on any form of computing machine-readable media discussed herein.

Some portions of the detailed descriptions herein are presented in terms of algorithms/routines and symbolic representations of operations on data bits within a computer memory. These algorithmic descriptions and representations are the means used by those skilled in the data processing arts to most effectively convey the substance of their work to others skilled in the art. An algorithm/routine is here, and generally, conceived to be a self-consistent sequence of steps leading to a desired result. The steps are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers, or the like. These algorithms/routine of the application including the program modules may be written in a number of different software programming languages such as C, C++, Java, HTML, or other similar languages.

It should be borne in mind, however, that all of these and similar terms are to be associated with the appropriate physical quantities and are merely convenient labels applied to these quantities. Unless specifically stated otherwise as apparent from the above discussions, it is appreciated that throughout the description, discussions utilizing terms such as "processing" or "computing" or "calculating" or "determining" or "displaying" or the like, refer to the action and processes of a computing system, or similar electronic computing device, that manipulates and transforms data represented as physical (electronic) quantities within the computing system's registers and memories into other data similarly represented as physical quantities within the computing system memories or registers, or other such information storage, transmission or display devices.

Although embodiments of this design have been fully described with reference to the accompanying drawings, it is to be noted that various changes and modifications will become apparent to those skilled in the art. Such changes and modifications are to be understood as being included within the scope of embodiments of this design as defined by the appended claims. For example, the device may include a barometer inside the housing of the device that also makes use of the microphone sealing component with one or more channels with the water resistant material for reasons of mechanical robustness as well as the pressure equalization benefit. Alternatively, the device may act as a barometer with the microphone seal with one or more channels to allow the sensed pressure internally in the device, the device uses this internal pressure to detect current depth of the device by the pressure. The invention is to be understood as not limited by the specific embodiments described herein, but only by scope of the appended claims.

What is claimed is:

1. A wearable electronic device, comprising:

a housing;

a processor in the housing, wherein the processor is configured to process commands to present an onscreen display on a display screen to enable the wearer of the electronic device to select a number of different operations;

a communication circuit in the housing, wherein the communication circuit is configured to transmit wirelessly to another computing device cooperating with the electronic device;

a microphone hole penetrating the housing which leads to a microphone; a microphone seal component; a waterproof material in the housing, where the microphone seal component has one or more channels and when compressed against the waterproof material is configured to provide multiple functions of i) allowing sound waves in air to pass through to the microphone located inside the housing behind the waterproof material and the microphone seal component, ii) while assisting to form a water tight seal for the microphone hole penetrating the housing, and iii) providing an air pressure equalization mechanism between an internal pressure inside the housing of the electronic device and atmospheric pressure external to the housing of the electronic device; and a non-transitory computer readable storage medium in the housing accessible to the processor and storing instructions executable by the processor to generate the number of different operations on the onscreen display.

2. The wearable electronic device of claim 1, wherein the microphone seal component has a front face with a fairly level surface on a first portion, a raised portion in a shape of an O-ring or some other gasket shape on a second portion of the front face, and where the one more channels are cut or molded into the fairly level surface on the first portion of the front face, and then has a center hole formed in the microphone seal component.

3. The wearable electronic device of claim 1, wherein the microphone connects to the housing through the microphone seal component with the one or more channels and through the waterproof material, where the waterproof material covers an opening inside the housing at a location where the microphone hole penetrates the housing, and where the waterproof material is made of a composite fabric with a gas permeable membrane to repel water molecules up to a pressure of at least three atmospheres (atms) of water pressure while allowing smaller molecules than water, and sound waves in air, to pass through the waterproof material.

4. The wearable electronic device of claim 2, wherein the gasket or O-ring shaped raised portion of the microphone seal component is made such that it has one or more gaps in that raised portion forming the O-ring or gasket, and where the one or more gaps in the raised portion correspond to locations leading into the one or more channels molded or cut into the microphone seal component.

5. The wearable electronic device of claim 4, wherein the gaps in the raised portion of the microphone seal component and corresponding channels are positioned relative to a type of the microphone installed in the housing in order to obtain optimum audio characteristics for sound waves coming in through the microphone hole, and where the waterproof material and the microphone seal component assist to form the water tight seal up to at least two atmospheres (atms) for the microphone hole penetrating the housing.

6. The wearable electronic device of claim 2, wherein a depth of a first channel goes below the fairly level surface of the front face of the microphone seal component, and dimensions of the depth, width, and shape of the one or more channels correspond to a type of the microphone installed inside the housing of the electronic device, where the depth, width, and shape of the first channel are created to provide at least a minimum acceptable audio performance design specification set by a manufacturer for the type of the microphone installed inside the housing of the electronic device, where a surface of the first channel is substantially smooth where notched surfaces are eliminated in the first channel, and where the notched surfaces significantly degrade a quality of the audio sound waves coming into and through a pathway of the microphone hole into the microphone.

7. The wearable electronic device of claim 1, wherein a depth of a first channel extends completely through the microphone seal component and the first channel is die cut out of the microphone seal component.

8. The wearable electronic device of claim 2, wherein a depth of a first channel goes below the fairly level surface of the front face of the microphone seal component, and dimensions of the depth, width, and shape of the one or more channels are cut or molded such that under maximum design compression of the housing an air relief pathway still exists so that pressure equalization can occur between the internal pressure inside the housing and the atmospheric pressure external to the housing.

9. The wearable electronic device of claim 1, wherein the electronic device is a wristwatch having a watch housing in which the onscreen display bears a time indication, either digital or analog, one or more manipulable physical buttons are arranged on the housing of the watch, a flexible wristband is engageable with the housing of the watch to hold the housing of the watch onto a human wearer, and a bezel, where the channels cooperate with the waterproof material to act as the air pressure equalization mechanism to prevent deformation in an appearance of the bezel and the display screen when the internal pressure inside the housing of the electronic device is significantly greater than the atmospheric pressure external to the housing of the electronic device.

10. The wearable electronic device of claim 1, wherein the electronic device has a bezel coupled to the display screen, where at least the bezel connects to a pliable sealing substrate to secure the bezel and corresponding display screen to the housing of the electronic device, where the pliable sealing substrate can expand and compress, and where the channels in the microphone seal component cooperate with the waterproof material to act as the air pressure equalization mechanism to help alleviate any deformation of the bezel and the display screen when exposed to expansion stresses as well as reduce an expansion and contraction cycling of the pliable sealing substrate when exposed to atmospheric pressure changes.

11. The wearable electronic device of claim 1, wherein the electronic device has a bezel coupled to the display screen and a lithium-based battery, where the lithium-based battery is located in the housing, where the lithium-based battery has at least 130 mAh in electrical power storage capacity, and is configured to power electronic components in a human-wearable electronic device including the display screen, the communication circuit, and the processor, where the display screen is selected from the group of any of an ePaper display, a monochrome LCD display, a color LED backlit display, and an OLED display, that all consume lower battery power than color LCD screens, and where the battery contains enough capacity of the at least 130 mAh to allow the display screen to stay on constantly and last up to five days on a single charge of the battery.

12. A microphone seal component with one or more channels, comprising:

a front face with a fairly level surface on a first portion; and a raised portion in a shape of an O-ring or some other gasket shape on a second portion of the front face, the one more channels cut or molded into the fairly level surface on the first portion of the front face, and then a center hole formed in the microphone seal component, where the microphone seal component has one or more channels that are configured to cooperate with a waterproof material, and when compressed against the waterproof material, the combination is configured to provide multiple functions of i) allowing sound waves in air to pass through to a microphone located inside a housing behind the waterproof material and the microphone seal component, ii) while assisting to form a water tight seal up to at least two atmospheres (atms) for a microphone hole penetrating the housing, and iii) providing an air pressure equalization mechanism between an internal pressure inside the housing and atmospheric pressure external to the housing.

13. The microphone seal component of claim 12, wherein the microphone connects to the housing through the microphone seal component with the one or more channels and through the waterproof material, where the waterproof material covers an opening inside the housing at a location where the microphone hole penetrates the housing, and where the waterproof material is made of a composite fabric with a gas permeable membrane to repel water molecules up to a pressure of at least three atmospheres of water pressure while allowing smaller molecules than water, and sound waves in air, to pass through the waterproof material.

14. The microphone seal component of claim 12, wherein the gasket or O-ring shaped raised portion on the surface of the microphone seal component is made such that it has one or more gaps in that raised portion forming the O-ring or gasket, and where the one or more gaps in the raised portion are correspondingly located to lead into the one or more channels molded or cut into the microphone seal component.

15. The microphone seal component of claim 12, wherein the gaps in the raised portion of the microphone seal component and corresponding channels are positioned relative to a type of the microphone installed in the housing in order to obtain optimum audio characteristics for sound waves coming in through the microphone hole.

16. The microphone seal component of claim 12, wherein a depth of a first channel goes below the fairly level surface of the front face of the microphone seal component, and dimensions of the depth, width, and shape of the one or more channels correspond to a type of the microphone installed inside the housing, where the depth, width, and shape of the first channel are created to provide at least a minimum acceptable audio performance design specification set by a manufacturer for the type of the microphone installed inside the housing, where a surface of the first channel is substantially smooth where notched surfaces are eliminated in the first channel, and where the notched surfaces significantly degrade a quality of the audio sound waves coming into and through a pathway of the microphone hole into the microphone.

17. The microphone seal component of claim 12, wherein a depth of a first channel extends completely through the microphone seal component and the first channel is die cut out of the microphone seal component.

18. The microphone seal component of claim 12, wherein a depth of a first channel goes below the fairly level surface of the face of the microphone seal component, and dimensions of the depth, width, and shape of the one or more channels are configured such that under maximum design compression of the housing an air relief pathway still exists so that pressure equalization can occur between the internal pressure inside the housing and the atmospheric pressure external to the housing.

19. A method of making a microphone hole for a wearable electronic device waterproof while also providing an air pressure equalization pathway, comprising:

using a microphone seal component that has a front face with a fairly level surface on a first portion, a raised portion in a shape of an O-ring or some other gasket shape on a second portion of the front face, one more channels cut or molded into the fairly level surface on the first portion of the front face, and then has a center hole formed in the microphone seal component to seal the microphone hole, which penetrates a housing which leads to a microphone; and using the microphone seal component and a waterproof material in the housing to cooperate with each other, where microphone seal component has one or more channels that when compressed against the waterproof material, the combination is configured to provide multiple functions of i) allowing sound waves in air to pass through to the microphone located inside the housing behind the waterproof material and the microphone seal component, ii) while assisting to form a water tight seal for the microphone hole penetrating the housing, and iii) providing an air pressure equalization mechanism between an internal pressure inside the housing of the electronic device and atmospheric pressure external to the housing of the electronic device.

20. The method of claim 19, further comprising:

coupling the microphone to the housing through the microphone seal component with the one or more channels and through the waterproof material, and covering an opening inside the housing at a location where the microphone hole penetrates the housing with the waterproof material, where the waterproof material is made of a composite fabric with a gas permeable membrane to repel water molecules up to a pressure of at least three atmospheres of water pressure while allowing smaller molecules than water, and sound waves of air, to pass through the waterproof material, wherein the electronic device is configured as a wristwatch having a watch housing in which an onscreen display bears a time indication, either digital or analog, a flexible wristband engageable with the housing of the watch to hold the housing of the watch onto a human wearer, and a bezel, where the channels cooperate with the waterproof material to act as the air pressure equalization mechanism to prevent deformation in an appearance of the bezel and the display screen when the internal pressure inside the housing of the electronic device is significantly greater than the atmospheric pressure external to the housing of the electronic device.

* * * * *